US011173525B2

(12) United States Patent
Floyd et al.

(10) Patent No.: US 11,173,525 B2
(45) Date of Patent: Nov. 16, 2021

(54) METHOD AND APPARATUS FOR REMOVING A FOULING SUBSTANCE FROM A PRESSURED VESSEL

(71) Applicant: RENMATIX, INC., King of Prussia, PA (US)

(72) Inventors: Daniel Clay Floyd, North Chesterfield, VA (US); Todd Michael Mclarty, Acworth, GA (US); Frederick John Moesler, Berwyn, PA (US); Charles Sebastian Sanderson, Wayne, PA (US)

(73) Assignee: Renmatix, Inc., King of Prussia, PA (US)

( * ) Notice: Subject to any disclaimer, the term of this patent is extended or adjusted under 35 U.S.C. 154(b) by 439 days.

(21) Appl. No.: 15/661,405

(22) Filed: Jul. 27, 2017

(65) Prior Publication Data

US 2017/0320109 A1 Nov. 9, 2017

Related U.S. Application Data

(63) Continuation of application No. 15/036,372, filed as application No. PCT/US2015/041805 on Jul. 23, 2015, now Pat. No. 9,751,114.

(51) Int. Cl.
*B08B 9/032* (2006.01)
*B08B 3/10* (2006.01)
(Continued)

(52) U.S. Cl.
CPC ..... *B08B 3/102* (2013.01); *B08B 3/08* (2013.01); *B08B 7/00* (2013.01); *B08B 7/0021* (2013.01); *B08B 9/08* (2013.01)

(58) Field of Classification Search
CPC ..... B08B 9/021; B08B 9/027; B08B 9/032; B08B 9/0321; B08B 9/0328; B08B 7/002
See application file for complete search history.

(56) References Cited

U.S. PATENT DOCUMENTS 1,628,530 A 5/1927 Burnett
2,123,434 A 7/1938 Paulson et al.
(Continued)

FOREIGN PATENT DOCUMENTS

CN 104791023 A 7/2015
EP 0484042 A1 5/1992
(Continued)

OTHER PUBLICATIONS

U.S. Appl. No. 15/036,372 (2017/0021396), filed Jul. 2, 2015 (Jan. 26, 2017), Daniel C. Floyd et al.
(Continued)

*Primary Examiner* — Mikhail Kornakov
*Assistant Examiner* — Ryan L Coleman
(74) *Attorney, Agent, or Firm* — Ballard Spahr LLP

(57) ABSTRACT

Vessels can be become fouled due to normal operation thereof, for example, during lignocellulosic biomass hydrolysis, and the vessel will become inoperable unless the fouling is removed from the vessel. Accordingly, methods are disclosed herein for removing fouling substances from the interior surfaces of fouled pressurized vessels. The methods utilize a brief rapid change of pressure in the vessel. In some embodiments, the rapid pressure change is a decrease, and the rapid pressure change causes, for example, increased velocity of the fluid flowing in the vessel, flashing of a portion of the fluid to vapor, and removal of the fouling substance adhered to the interior surface of the vessel.

19 Claims, 4 Drawing Sheets

(51) Int. Cl.

| | |
|---|---|
| ***B08B 7/00*** | (2006.01) |
| ***B08B 3/08*** | (2006.01) |
| ***B08B 9/08*** | (2006.01) |

(56) References Cited

U.S. PATENT DOCUMENTS

| | | | | |
|---|---|---|---|---|
| 3,409,470 | A | 11/1968 | Karpovich | |
| 3,457,108 | A | 7/1969 | Hittel | |
| 3,805,880 | A | 4/1974 | Lawlar | |
| 4,099,703 | A | 7/1978 | Lush | |
| 4,366,832 | A | 1/1983 | Henszey | |
| 4,541,456 | A | 9/1985 | Troy | |
| 4,632,705 | A | 12/1986 | Baum | |
| 4,770,793 | A | 9/1988 | Treffry-Goatley et al. | |
| 4,786,352 | A | 11/1988 | Benzing | |
| 4,962,776 | A | 10/1990 | Liu et al. | |
| 4,974,617 | A | 12/1990 | Simon | |
| 5,183,513 | A | 2/1993 | Sajewski | |
| 5,265,629 | A | 11/1993 | Sajewski | |
| 5,413,168 | A | 5/1995 | Baum | |
| 5,440,824 | A | 8/1995 | Ramachandran et al. | |
| 5,674,323 | A | 10/1997 | Garcia | |
| 5,829,678 | A | 11/1998 | Hunter et al. | |
| 6,250,388 | B1 | 6/2001 | Carmi et al. | |
| 6,527,869 | B1 | 3/2003 | Bourg | |
| 6,678,832 | B1 | 1/2004 | Gotanda | |
| 7,421,757 | B1 | 9/2008 | Garcia, Jr. | |
| 2002/0011210 | A1* | 1/2002 | Satoh | C23C 16/4405 118/715 |
| 2002/0014257 | A1 | 2/2002 | Chandra et al. | |
| 2002/0029792 | A1 | 3/2002 | Carmi et al. | |
| 2003/0047195 | A1* | 3/2003 | DeYoung | B08B 7/0021 134/12 |
| 2004/0006841 | A1 | 1/2004 | Jameel et al. | |
| 2004/0103922 | A1 | 6/2004 | Inoue | |
| 2005/0028927 | A1 | 2/2005 | Basceri et al. | |
| 2005/0126587 | A1 | 6/2005 | Bitter et al. | |
| 2007/0287125 | A1 | 12/2007 | Weill | |
| 2008/0073063 | A1 | 3/2008 | Clavenna et al. | |
| 2009/0159536 | A1 | 6/2009 | Hong | |
| 2010/0044047 | A1 | 2/2010 | Kabishcher et al. | |
| 2012/0282465 | A1 | 11/2012 | Kadam et al. | |
| 2015/0056556 | A1* | 2/2015 | Lin | C08L 33/00 430/285.1 |
| 2016/0004158 | A1* | 1/2016 | Chen | H05K 3/3452 174/256 |
| 2017/0021396 | A1 | 1/2017 | Floyd et al. | |

FOREIGN PATENT DOCUMENTS

| | | | |
|---|---|---|---|
| EP | 2303990 | A2 | 4/2011 |
| JP | H0515465 | A | 1/1993 |
| JP | 2001300448 | A | 10/2001 |
| WO | WO-98/029186 | A1 | 7/1998 |
| WO | WO-01/94041 | A | 12/2001 |
| WO | WO-2009/131757 | A2 | 10/2009 |
| WO | WO-2012/063239 | A2 | 5/2012 |
| WO | PCT/US2015/041805 | | 7/2015 |
| WO | WO-2017/014791 | | 1/2017 |

OTHER PUBLICATIONS

European Search Report and Written Opinion dated Feb. 14, 2019 by the European Patent Office for Patent Application No. 15899101.8, which was filed on Feb. 21, 2018 and published as EP 3325183 on May 30, 2018 (Inventor—Floyd et al.; Applicant—Renmatix, Inc.) (11 pages).

International Search Report and Written Opinion dated Apr. 15, 2016 by the International Searching Authority for International Patent Application No. PCT/US2015/041805, which was filed on Jul. 23, 2015 and published as WO 2017/014791 on Jan. 26, 2017 (Inventor—Floyd et al.; Applicant—Renmatix, Inc.) (10 pages).

Preliminary Amendment filed on May 12, 2016 with the U.S. Patent and Trademark Office for U.S. Appl. No. 15/036,372, filed May 12, 2016 and published as US 2017/0021396 on Jan. 26, 2017 (Inventor—Floyd et al.; Applicant—Renmatix, Inc.) (10 pages).

Non-Final Office Action dated Dec. 22, 2016 by the U.S. Patent and Trademark Office for U.S. Appl. No. 15/036,372, filed May 12, 2016 and published as US 2017/0021396 on Jan. 26, 2017 (Inventor—Floyd et al.; Applicant—Renmatix, Inc.) (5 pages).

Response to Non-Final Office Action filed on Mar. 22, 2017 with the U.S. Patent and Trademark Office for U.S. Appl. No. 15/036,372, filed May 12, 2016 and published as US 2017/0021396 on Jan. 26, 2017 (Inventor—Floyd et al.; Applicant—Renmatix, Inc.) (4 pages).

Notice of Allowance dated May 2, 2017 by the U.S. Patent and Trademark Office for U.S. Appl. No. 15/036,372, filed May 12, 2016 and published as US 2017/0021396 on Jan. 26, 2017 (Inventor—Floyd et al.; Applicant—Renmatix, Inc.) (10 pages).

Examination Report dated Sep. 15, 2020 by the Canadian Patent Office for CA Application No. 3,029,788, which was filed on Jul. 23, 2015 (Inventor—Floyd et al.; Applicant—Renmatix, Inc.) (3 pages).

* cited by examiner

METHOD AND APPARATUS FOR REMOVING A FOULING SUBSTANCE FROM A PRESSURED VESSEL

CROSS-REFERENCE TO RELATED APPLICATIONS

This application is a continuation of U.S. application Ser. No. 15/036,372 filed May 12, 2016, currently pending, which is a U.S. National Phase Application of International Application No. PCT/US2015/041805, filed Jul. 23, 2015, each of which is hereby incorporated by reference in its entirety.

FIELD OF THE INVENTION

Disclosed herein are methods for removing fouling substances from the interior surfaces of vessels. More particularly, methods are disclosed for removing fouling substances, especially those originating from lignocellulosic biomass, from the interior surfaces of pressurized vessels.

BACKGROUND OF THE INVENTION

Hydrolysis of biomass using supercritical water is a complex process. In addition, the biomass is a complex material containing polymeric saccharides, aromatic polymers, organic acids, extractives, ash, and the like. Supercritical fluids, including supercritical water, have solubility, reactivity, density, and viscosity that are different from the same fluid in subcritical form. The use of supercritical water to hydrolyze the polymeric saccharides has been found to be a cost-effective way to produce cellulosic sugars for use, inter alia, in biofuels and industrial biochemicals.

When processing biomass with high temperature fluids, such as a supercritical fluid, fouling can occur on the walls of the reaction vessels, such as tubular reactors. This fouling builds up over time, constricting the flow path and eventually leading to high pressure drops and reduced vessel volume. One common approach to address the problem is to take the reaction vessel offline and manually clean it with brushes and/or chemicals (e.g., caustic). While this approach works for some applications, it unfortunately involves stopping production of that particular reactor for the period of the cleaning. This can result in either higher capital costs (if multiple reactors or arrays are utilized to compensate for the down time), reduced throughput (less material produced per annum due to downtime), or both.

Thus, there is an ongoing need for methods that clean the system with minimal or essentially no down time and, preferably, without the addition of exogenous chemicals. The methods disclosed herein are directed toward these, as well as other, important ends.

SUMMARY OF THE INVENTION

Disclosed herein are methods that generally relate to removing fouling substances from the interior surface of a vessel. More particularly, disclosed are methods for removing fouling substances, especially those derived from lignocellulosic biomass, from the interior surface of a pressurized vessel. The methods disclosed herein clean a pressurized vessel with minimal or essentially no down time and, in some embodiments, without the addition of exogenous chemicals. The methods utilize a brief release of pressure in the vessel, in which, in some embodiments, the pressure is present as a result of normal operation of the equipment (e.g., processing of materials, such as hydrothermal processing of lignocellulosic biomass). The release of pressure causes an increase in linear velocity of a fluid therein and, in some embodiments, a rapid acceleration of fluid therein, thereby removing a portion of (e.g., a substantial portion of) the fouling substance that is adhered to an interior surface of the pressurized vessel. Without being limited by theory, it is believed that this high linear velocity, rapid acceleration if present (of the fluid, any removed foulant, and any added exogenous solids), momentum transfer, possibly a "popcorn effect" of the process liquid boiling and thus rapidly expanding within the interstices of the adhered fouling material, or any combination thereof, fragment and scour the fouling substance and push out any removed fouling material, among other possible contributing factors. The increased throughput has the benefit of improving the overall yield due to the higher uptime of the system. Furthermore, the methods disclosed herein allow for the use of fewer reaction vessels and increases in overall system yield.

The thermophysical properties of the system are utilized to clean the reactor in place by changing the pressure of the system. By rapidly dropping the pressure in the reactor, the density of its contents dramatically decreases, which in turn dramatically increases the velocity profile of the contents in the reactor. This velocity profile results in a physical "scouring effect," which removes the adhered material from the inside surface of the reactor and blows it out of the reactor. Within seconds or less, the reactor is substantially clean, the pressure is returned to normal operating pressure, and the system is operational again. In some embodiments, a rapid increase in pressure is employed, along with other concomitant effects (e.g., increased velocity flow, "scouring," density change, etc.) which also removes fouling.

Accordingly, disclosed herein is a method comprising, consisting of, or consisting essentially of:

providing a first pressurized vessel having an interior surface;

contacting the interior surface of the first pressurized vessel with a first fouling fluid;

wherein:

the first pressurized vessel has a first pressure at a first position inside the first pressurized vessel; and the first fouling fluid has a first velocity at the first position;

depositing a first fouling substance originating from the first fouling fluid on at least a portion of the interior surface of the first pressurized vessel, thereby forming a fouled first pressurized vessel having a second pressure at the first position, wherein the first fouling fluid has a second velocity at the first position;

optionally, displacing at least a portion of the first fouling fluid contained in the fouled first pressurized vessel with a first fluid that is different from the first fouling fluid; and rapidly changing the second pressure to a third pressure, thereby causing the first fouling fluid, the first fluid if present, or a mixture thereof within the fouled first pressurized vessel to achieve a third velocity at the first position, wherein the third velocity is greater than the second velocity;

wherein the method removes a portion of the first fouling substance deposited on the interior surface of the fouled first pressurized vessel.

BRIEF DESCRIPTION OF THE DRAWINGS

The accompanying drawings, which are included to provide a further understanding of the methods disclosed herein and are incorporated in and constitute a part of this specification, illustrate embodiments of the invention and together with the description serve to explain the principles of the invention. In the drawings.

DETAILED DESCRIPTION OF THE INVENTION

Figure 1:
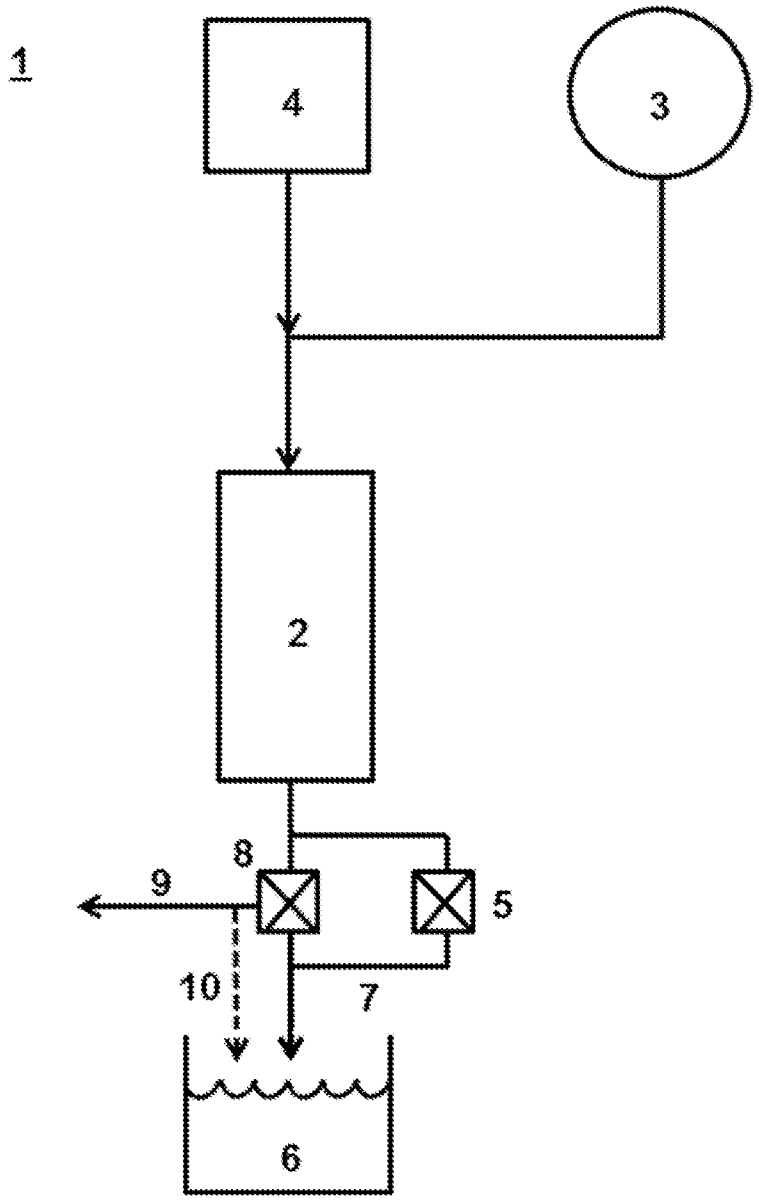
FIG. 1 is a schematic diagram of the method in some embodiments.

As employed above and throughout the disclosure, the following terms, unless otherwise indicated, shall be understood to have the following meanings.

As used herein, the singular forms "a," "an," and "the" include the plural reference unless the context clearly indicates otherwise.

While the present invention is capable of being embodied in various forms, the description below of several embodiments is made with the understanding that the present disclosure is to be considered as an exemplification of the invention, and is not intended to limit the invention to the specific embodiments illustrated. Headings are provided for convenience only and are not to be construed to limit the invention in any manner. Embodiments illustrated under any heading may be combined with embodiments illustrated under any other heading. In addition, any feature disclosed herein may be combined with any other feature disclosed herein.

The use of numerical values in the various quantitative values specified in this application, unless expressly indicated otherwise, are stated as approximations as though the minimum and maximum values within the stated ranges were both preceded by the word "about." In this manner, slight variations from a stated value can be used to achieve substantially the same results as the stated value. Also, the disclosure of ranges is intended as a continuous range including every value between the minimum and maximum values recited as well as any ranges that can be formed by such values. Also disclosed herein are any and all ratios (and ranges of any such ratios) that can be formed by dividing a recited numeric value into any other recited numeric value. Accordingly, the skilled person will appreciate that many such ratios, ranges, and ranges of ratios can be unambiguously derived from the numerical values presented herein and in all instances such ratios, ranges, and ranges of ratios represent various embodiments of the present invention.

As used herein, the phrase "substantially free" means have no more than about 1%, preferably less than about 0.5%, more preferably, less than about 0.1%, by weight of a component, based on the total weight of any composition containing the component, on a dry solids basis.

A supercritical fluid is a fluid at a temperature above its critical temperature and at a pressure above its critical pressure. A supercritical fluid exists at or above its "critical point," the point of highest temperature and pressure at which the liquid and vapor (gas) phases can exist in equilibrium with one another. Above critical pressure and critical temperature, the distinction between liquid and gas phases disappears. A supercritical fluid possesses approximately the penetration properties of a gas simultaneously with the solvent properties of a liquid. Accordingly, supercritical fluid extraction has the benefit of high penetrability and good solvation.

Reported critical temperatures and pressures include: for pure water, a critical temperature of about 374.2° C., and a critical pressure of about 221 bar; for carbon dioxide, a critical temperature of about 31° C. and a critical pressure of about 72.9 atmospheres (about 1072 psig). Near-critical water has a temperature at or above about 300° C. and below the critical temperature of water (374.2° C.), and a pressure high enough to ensure that all fluid is in the liquid phase. Sub-critical water has a temperature of less than about 300° C. and a pressure high enough to ensure that all fluid is in the liquid phase. Sub-critical water temperature may be greater than about 250° C. and less than about 300° C., and in many instances sub-critical water has a temperature between about 250° C. and about 280° C. The term "hot compressed water" is used herein for water that is at a temperature at or above 100° C. and at a pressure above atmospheric pressure, such that some or all of the water is present in liquid or supercritical form. In some embodiments, the pressure is sufficient to ensure that all of the water is present in liquid or supercritical form (i.e., water is not present in vapor form). In some embodiments, HCW is subcritical water. In some embodiments, HCW is near-critical water. In some embodiments, HCW is supercritical water. In some embodiments, HCW is part of a fluid, i.e., a fluid can comprise HCW. As used herein, "a fluid comprising hot compressed water" indicates that the fluid comprises water, and the fluid is at a temperature at or above 100° C. and at a pressure above atmospheric pressure.

As used herein, a fluid which is "supercritical" (e.g. supercritical water, supercritical $CO_2$, etc.) indicates a fluid which would be supercritical if present in pure form under a given set of temperature and pressure conditions. For example, "supercritical water" indicates water present at a temperature of at least about 374.2° C. and a pressure of at least about 221 bar, whether the water is pure water, or present as a mixture (e.g. water and ethanol, water and $CO_2$, etc.). Thus, for example, "a mixture of sub-critical water and supercritical carbon dioxide" indicates a mixture of water and carbon dioxide at a temperature and pressure above that of the critical point for carbon dioxide but below the critical point for water, regardless of whether the supercritical phase contains water and regardless of whether the water phase contains any carbon dioxide. For example, a mixture of sub-critical water and supercritical $CO_2$ may have a temperature of about 250° C. to about 280° C. and a pressure of at least about 225 bar.

As used herein, "a saturated state" refers to a substance at vapor-liquid equilibrium, where a liquid and its vapor (gas phase) are in equilibrium with each other, such that the rate of evaporation (liquid changing to vapor) equals the rate of condensation (vapor changing to liquid), wherein there is no net (overall) vapor-liquid interconversion.

As used herein, "a subcooled state" refers to a compressed fluid at a temperature lower than its saturation temperature (boiling point) at a given pressure causing it to be in a liquid state (rather than a gas), due to mechanical and/or thermodynamic conditions.

As used herein, the term "upon commencing" means the state of a particular fluid or portion of the system, etc., at the moment in time that something (e.g., rapid pressure change)

is commenced. For example, in the context of the state of a fouling fluid "upon commencing" the rapid pressure change step, the fouling fluid is in the specified state at the moment that the rapid pressure change begins. Specifically, in some embodiments, if it is stated that upon commencing the rapid pressure changing step the fouling fluid is in a supercritical state, then it means that the fouling fluid is in a supercritical state at the moment in time that the rapid pressure change is commenced. While the state of the indicated fluid may change as the pressure is changed (decreased or increased), it is the state of the indicated fluid upon initiating the rapid pressure change that is important in this context.

As used herein, the term "biomass" means a renewable energy source generally comprising carbon-based biological material derived from living or recently-living organisms. Suitable feedstocks include lignocellulosic feedstock, cellulosic feedstock, hemicellulosic feedstock, starch-containing feedstocks, etc. The lignocellulosic feedstock can be from any lignocellulosic biomass, such as plants (e.g., duckweed, annual fibers, etc.), trees (softwood, e.g., fir, pine, spruce, etc.; tropical wood, e.g., balsa, iroko, teak, etc.; or hardwood, e.g., elm, oak, aspen, pine, poplar, willow, eucalyptus, etc.), bushes, grass (e.g., miscanthus, switchgrass, rye, reed canary grass, giant reed, or sorghum), dedicated energy crops, municipal waste (e.g., municipal solid waste), and/or a by-product of an agricultural product (e.g., corn, sugarcane, sugar beets, pearl millet, grapes, rice, straw). The biomass can be from a virgin source (e.g., a forest, woodland, or farm) and/or a by-product of a processed source (e.g., off-cuts, bark, and/or sawdust from a paper mill or saw mill, sugarcane bagasse, corn stover, palm oil industry residues, branches, leaves, roots, and/or hemp). Suitable feedstocks may also include the constituent parts of any of the aforementioned feedstocks, including, without limitation, lignin, C6 saccharides (including cellulose, cellobiose, C6 oligosaccharides, and C6 monosaccharides), C5 saccharides (including hemicellulose, C5 oligosaccharides, and C5 monosaccharides), and mixtures thereof. Biomass can also be a residue resulting from processing of lignocellulosic biomass. For example, hemicellulose may have been partially or substantially removed from a starting lignocellulosic biomass, resulting in a processed biomass residue comprising, e.g., lignin and cellulose.

As used herein, the term "fouling substance" typically refers to a solid or semi-solid that is adhered to the interior surface of a pressurized vessel (e.g., fouled pressurized vessel). In the case of a vessel in the shape of a pipe or tube, the fouling substance deposits typically in the form of a coating on the concave portion of the inner wall of the pipe or tube, thereby constricting flow through the vessel. "Adhered" means that some sort of attraction exists between the fouling substance and the interior surface of the vessel. Simply for explanatory purposes, consider a glass bead, which has no attraction to a glass tabletop when set on, or even gently pressed, to the tabletop, and thus the bead is not adhered to it. In contrast, a piece of freshly chewed bubblegum set on or gently pressed to a glass tabletop will exhibit an attraction to it, and therefore would be considered to be adhered thereon. The term "fouling substance" can also refer to the solid or semi-solid after it has been removed from the interior surface, or to the compound or compounds in the fouling fluid (whether dissolved or not) that ultimately form the solid or semi-solid adhered to the interior surface. In addition, the "fouling substance" can also refer to a compound or compounds that settle on the interior surface and ultimately fuse or interlock (chemically, physically, or both) to form a solid or semi-solid mass having dimensions that prevent it from continuing along at the same velocity as the flow of fluid (e.g., an annular mass in the shape of a cylinder, potentially hollow, that is lodged in the vessel, sometimes but not always upstream of a bend in the vessel). A fouling substance, as used herein, does not include a solid or semi-solid that is merely settled on, but not a fused or interlocked mass and/or or adhered to, the interior surface of the vessel (under the normal processing conditions). Depositing a fouling substance does not include the accumulation of debris or foreign matter that lodges at the restricted flow position, for example, in a needle valve between the needle and the orifice, unless such material subsequently adheres to that surface, or fuses or interlocks to form a mass as described above. A "semi-solid," as used herein, refers to a viscous material having properties somewhat in between a solid and a liquid (e.g., consider a substance like molasses). In some embodiments, the fouling substance (or compounds that ultimately form the fouling substance) prior to adhering to the interior surface of a vessel (or forming a fused and/or interlocked mass) may be structurally different than the fouling substance during or after it becomes adhered to the surface or forming a fused/interlocked mass (e.g., by way of formation of new chemical bonds, including those resulting from cross-linking, for example), or after it has been removed from the surface or after the mass has been fragmented (e.g., by way of breaking chemical bonds or decomposing the material). In any event, the term "fouling substance," as used herein, encompasses the material before, during, and after adhering to the interior surface of the vessel (or forming a fused/interlocked mass), regardless of a structural change of the fouling substance, if any.

As used herein, "fouled" refers to a vessel having an interior surface where a solid or semi-solid deposit has been adhered to its interior surface and/or a fused/interlocked mass is present, as described elsewhere herein.

As used herein, "fluid" refers to a liquid, a gas, or a supercritical fluid, either with or without insoluble solids, and either with or without dissolved components.

As used herein, "rapidly changing," when used in conjunction with a pressure change, means decreasing or increasing the pressure at a rate sufficient to remove at least a portion (e.g., a substantial portion) of a fouling substance adhered to the interior surface of a fouled vessel. In some embodiments, a pressure change of at least about 100 psi/sec is considered a rapid change in pressure. In some embodiments, the pressure change is a pressure decrease. However, in some embodiments, the pressure change is a pressure increase. Pressure change typically is measured relative to a single position within (i.e., inside of) a reactor or vessel upstream of a letdown and/or blowout valve that causes the rapid pressure change to occur. However, in certain contexts, the position can be downstream of a valve, e.g., in the case of describing a rapid pressure increase, for example, which will be clear from context. Rapid pressure changes (increase or decrease) are described further elsewhere herein.

As used herein, "originating from," when used in conjunction with a fouling substance, means that compounds present in the fouling fluid, including starting materials, full and partial hydrolysis products, and degradation products, etc., are those that are deposited on an interior surface of a vessel.

When disclosing numerical values herein, for example, 1, 2, 3, 4, 5, 6, 7, 8, 9, 10, the following sentence typically follows such numerical values: "Each of the foregoing numbers can be preceded by the term 'about,' 'at least about,' or 'less than about,' and any of the foregoing numbers can be used singly to describe an open-ended range or in combination to describe a close-ended range." This sentence means that each of the aforementioned numbers can be used alone (e.g., 4), can be prefaced with the word "about" (e.g., about 8), prefaced with the phrase "at least about" (e.g., at least about 2), prefaced with the phrase "less than about" (e.g., less than about 7), or used in any combination to define a range (e.g., 2 to 9, about 1 to 4, 8 to about 9, about 1 to about 10, and so on).

Although the descriptions herein sometimes simply refer to "a pressurized vessel," "a fouling substance," "a fouled pressurized vessel," "a fluid," etc., it should be understood that such disclosures independently apply generally to any pressurized vessel, any fouling substance, any fouled pressurized vessel, and any fluid, etc., unless otherwise clearly contradicted by context. In this regard, designations such as "first" or "second" sometimes are used to differentiate the pressurized vessels, fouling substances, fluids, etc., and general disclosures herein may be independently applied to any of these specific vessels, fouling substances, etc. Additionally, the designations "first," "second," "third," etc. may be applied to any term herein so as to clearly define the methods described herein. Typically, certain terms herein are consistently used in relation to a first pressurized vessel, whereas other terms are consistently used in relation to a second pressurized vessel (although the methods herein do not require a second pressurized vessel). In general, certain terms used in relation to the first pressurized vessel correspond to (but are independent from) certain terms used in relation to the second pressurized vessel, for example, a first fouling fluid in the first pressurized vessel corresponds to a second fouling fluid in the second pressurized vessel. As such, any disclosure herein discussing the first fouling fluid is equally applicable to (but selected independent from) the second fouling fluid. Other corresponding (yet independent) terms are as follows: in the first pressurized vessel, (1) a first pressure, (2) a first position, (3) a first velocity, (4) a first fouling substance, (5) a fouled first pressurized vessel, (6) a second pressure, (7) a second velocity, (8) a first fluid, (9) a third pressure, (10) a third velocity, and (11) an eighth pressure are comparable to the following terms in the second pressurized vessel: (1) a fifth pressure, (2) a second position, (3) a fourth velocity, (4) a second fouling substance, (5) a fouled second pressurized vessel, (6) a sixth pressure, (7) a fifth velocity, (8) a second fluid, (9) a seventh pressure, (10) a sixth velocity, and (11) a ninth pressure, respectively.

Accordingly, in some embodiments, the methods disclosed herein comprise, consist of, or consist essentially of:

providing a first pressurized vessel having an interior surface;

contacting the interior surface of the first pressurized vessel with a first fouling fluid;

wherein:

the first pressurized vessel has a first pressure at a first position inside the first pressurized vessel; and the first fouling fluid has a first velocity at the first position;

depositing a first fouling substance originating from the first fouling fluid on at least a portion of the interior surface of the first pressurized vessel, thereby forming a fouled first pressurized vessel having a second pressure at the first position, wherein the first fouling fluid has a second velocity at the first position;

optionally, displacing at least a portion of the first fouling fluid contained in the fouled first pressurized vessel with a first fluid that is different from the first fouling fluid; and rapidly changing the second pressure to a third pressure, thereby causing the first fouling fluid, the first fluid if present, or a mixture thereof within the fouled first pressurized vessel to achieve a third velocity at the first position, wherein the third velocity is greater than the second velocity;

wherein the method removes a portion of the first fouling substance deposited on the interior surface of the fouled first pressurized vessel.

In some embodiments, the methods disclosed herein are carried out substantially without interruption. For example, the contacting, depositing, optional displacing, and rapid changing steps of the methods disclosed herein are carried out without any substantial interruption therebetween. In some embodiments, in the event that the displacing step is performed, a substantial interruption would include, for example, completely depressurizing a fouled pressurized vessel to atmospheric pressure or near atmospheric pressure (e.g., less than 100 psia) after the depositing step but before the displacing step. In some embodiments, the uptime of the system can be 90%, 91%, 92%, 93%, 94%, 95%, 95.5%, 96%, 96.5%, 97%, 97.5%, 98%, 98.5%, 99%, 99.5%, or 99.9%. Each of the foregoing numbers can be preceded by the term "about," "at least about," or "less than about," and any of the foregoing numbers can be used singly to describe an open-ended range or in combination to describe a close-ended range. Uptime, as used herein, is the percentage of total time that the system is performing its normal function, such as hydrolyzing or processing biomass, exclusive of the duration of the rapid pressure changing step and adjusting step, during one cycle (or an average of two or more cycles) of the methods disclosed herein. For example, total time measurement starts when the system reaches operating conditions and begins processing biomass, and includes the contacting, depositing, optional displacing, rapid changing, and adjusting steps. Once the adjusting step is finished (i.e., the fourth pressure is reached), total time measurement is complete. The uptime is then calculated by subtracting the time taken for the rapid pressure change and adjusting steps, and dividing the result by the total time. As such, as used herein, uptime is not a measure of the portion of a calendar year that the system is performing its normal function (e.g., hydrolyzing biomass), which might include, e.g., entire days or weeks that a vessel/reactor is taken offline for repairs that have nothing to do with removing a fouling substance. In some embodiments, if desired, the uptime can be averaged over two or more cycles (e.g., 3, 4, 5, 6, 7, 8, 9, 10, 11, 12, 13, 14, or 15 cycles). To calculate the uptime for a process that does not employ the methods disclosed herein, but rather takes the system offline (e.g., substantial or complete depressurization) to clean the vessel/reactor followed by restarting the system to again process biomass, total time measurement starts when the system reaches operating conditions and begins processing biomass, and includes any shutting down time, disassembly time (if any), cleaning time, reinstallation time (if any), and time for returning the system to normal conditions for processing biomass in the given system. Uptime is then calculated by subtracting the shutting down time, disassembly time (if any), cleaning time, reinstallation time (if any), and time for returning the system to normal conditions, and dividing the result by the total time. Notably, uptime cannot be calculated herein for embodiments that do not employ the adjusting step (or that do not otherwise resume the process after cleaning, e.g., in the case of system repairs not related to fouling).

In some embodiments, the fouling fluid (e.g., first fouling fluid, second fouling fluid, or both) comprises a material selected from the group consisting of biomass, municipal waste, fractionated biomass, hemicellulose, cellulose, cello-oligosaccharides, glucose, xylan, xylo-oligosaccharides, xylose, $C_6$ oligosaccharides, $C_5$ oligosaccharides, $C_6$ monosaccharides, $C_5$ monosaccharides, lignin, starch, lipids, proteins, polypeptides, polymers (e.g., polyisoprene, latex, poly (alkyl)acrylate, polyester, polyamide, etc.), oligomers (e.g., oligomers of the monomer units making up any of the aforementioned polymers), furfural, hydroxymethyl furfural, and any combination thereof. In some embodiments, the fouling fluid comprises lignin and cellulose. In some embodiments, the fouling fluid comprises lignin and C6 oligosaccharides. In some embodiments, the fouling fluid comprises lignin and C6 monosaccharides. In some embodiments, the fouling fluid comprises C6 oligosaccharides and C6 monosaccharides. In some embodiments, the fouling fluid comprises lignin, C6 oligosaccharides, and furfural.

In some embodiments, the fouling fluid (e.g., first fouling fluid, second fouling fluid, or both) comprises water. In some embodiments, the fouling fluid comprises hot compressed water. In some embodiments, the fouling fluid comprises sulfur dioxide, carbon dioxide, ethanol, methanol, or any combination thereof. In some embodiments, the fouling fluid comprises water (e.g., hot compressed water) and sulfur dioxide.

In some embodiments, the fouling fluid (e.g., first fouling fluid, second fouling fluid, or both) is an aqueous slurry with a solids content of 1 wt. %, 3 wt. %, 5 wt. %, 7 wt. %, 9 wt. %, 10 wt. %, 12 wt. %, 14 wt. %, 16 wt. %, 18 wt. %, 20 wt. %, 22 wt. %, 24 wt. %, 26 wt. %, 28 wt. %, 30 wt. %, 32 wt. %, 34 wt. %, 36 wt. %, 38 wt. %, or 40 wt. %, based on the total weight of the aqueous slurry on a dry basis. Each of the foregoing numbers can be preceded by the term "about," "at least about," or "less than about," and any of the foregoing numbers can be used singly to describe an open-ended range or in combination to describe a close-ended range.

In some embodiments, the fouling substance (e.g., first fouling substance, second fouling substance, or both) is selected from the group consisting of an organic material, lignin, a polyfuran, a humin, char, a degradation product of a natural material (e.g., sugar, lignin, etc.), a degradation product of a synthetic material, ash, inorganic material, and any combination thereof.

In some embodiments, the first fouling fluid contained in the fouled first pressurized vessel can optionally be displaced with a first fluid that is different from the first fouling fluid. Similarly, the second fouling fluid contained in the fouled second pressurized vessel can optionally be displaced with a second fluid that is different from the second fouling fluid. In these contexts, "different" means that, e.g., the first fluid and the first fouling fluid have different compositions (at least one different component) or have the same composition where the components are at different concentrations. For example, it may be desirable to use water or diluted first fouling fluid, rather than the first fouling fluid (which is a product producing fluid), in the rapid pressure changing step to avoid wasting the product producing fluid.

In some embodiments, the displacing step includes the use of a volume of fluid (e.g., first fluid, second fluid, or both) to push the fouling fluid (e.g., first fouling fluid, second fouling fluid, or both) out of the vessel (i.e., the volume of first fluid displaces the first fouling fluid). In some embodiments, the displacing step includes at least partially removing (or even fully removing) the fouling fluid (e.g., first fouling fluid, second fouling fluid, or both) from the pressurized vessel prior to feeding the fluid (e.g., first fluid, second fluid, or both) into the pressurized vessel and without substantial interaction with the first fluid. In some embodiments, the displacing step is performed and precedes the rapid pressure changing step. In some embodiments, the displacing step is performed and occurs substantially simultaneously with the rapid pressure changing step. In some embodiments, the displacing step is performed and occurs after the rapid pressure changing step.

In embodiments where a fluid is used to displace a fouling fluid, the term "mixture" includes mixtures formed by complete mixing (where, for example, the first fouling fluid and the first fluid are completely or nearly completely intermingled and homogenous) or mixtures formed by incomplete mixing (where, for example, the first fouling fluid and the first fluid only partially mix at the interface between the two fluid, and the first fluid is substantially free of the first fouling fluid on one side of the interface, and the first fouling fluid is substantially free of the first fouling fluid on the other side of the interface).

As used herein, the velocity of a fluid or fouling fluid refers to its velocity within a vessel and not to the velocity of any effluent exiting the vessel at a pressure lower than that inside the vessel (for example, the fluid that exists in the vessel during flashing), unless context clearly indicates otherwise. The velocity, as used herein, typically is measured relative to a single position within (i.e., inside of) a vessel, typically upstream of a valve used to cause the rapid pressure change. In some embodiments, this position (e.g., the first position) is the same position (e.g., the first position) where the pressure is measured in the context of the rapid pressure change step. In some embodiments, the position is upstream of the letdown and/or blowout valve used to cause the rapid pressure change, but in some embodiments the position downstream of the letdown and/or blowout valve used to cause the rapid pressure change, as will be clear in context.

In some embodiments, at least a portion of the fouling substance (e.g., first fouling substance) deposited on the interior surface of the fouled pressurized vessel (e.g., fouled first pressurized vessel) is removed by the methods disclosed herein. For example, 30 wt. %, 35 wt. %, 40 wt. %, 45 wt. %, 50 wt. %, 55 wt. %, 60 wt. %, 65 wt. %, 70 wt. %, 75 wt. %, 80 wt. %, 85 wt. %, 90 wt. %, 95 wt. %, 99 wt. %, or 100 wt. %, on a dry basis, of the deposited fouling substance is removed from the interior surface of the fouled first pressurized vessel. Each of the foregoing numbers can be preceded by the term "about," "at least about," or "less than about," and any of the foregoing numbers can be used singly to describe an open-ended range or in combination to describe a close-ended range. In some embodiments a substantial portion is removed. As used herein, the term "substantial portion" means at least about 50 wt. %, preferably at least about 75 wt. %, and more preferably at least about 90 weight %, of the fouling substance adhered to the interior surface of the fouled pressurized vessel is removed.

The amount of fouling substance removed using the methods disclosed herein can be measured relative to the total weight of the fouling substance present on the fouled pressurized vessel upon commencing the rapid pressure change step, on a dry basis. The amount of fouling substance present upon commencing the rapid pressure change step can be determined, or at least closely approximated, by performing an otherwise identical method, except without the rapid pressure change step (i.e., a gradual pressure change is performed instead, so as to relatively gently return the vessel to ambient conditions so that measurement of the fouling substance can be made). In this "otherwise identical method," upon commencing the gradual pressure change, the flow of the fouling fluid should be stopped and a small volume of "cold" water (e.g., <150° C.) used to displace the fouling fluid from the vessel, so as to cease any more buildup of fouling substance on the interior surface of the vessel. A section of the vessel, such as a section of pipe or tube, may be removed to measure the amount of fouling substance present, for example, by weighing the removed section of the vessel.

During the depositing of a fouling substance onto at least a portion of the interior surface of a pressurized vessel, the pressure inside the pressurized vessel may in some embodiments steadily decrease as the fouling substance builds up on the interior surface, assuming all other variables are kept constant (such as slurry inlet pressure). However, in some embodiments, as a result of the pressure change due to fouling, the system can be modulated in such as way (e.g., increasing the inlet pressure of the incoming slurry) that the observed pressure at the first position in the vessel is substantially the same as, or even higher than, the pressure at the first position without fouling. As fouling occurs, typically there is a pressure drop across the vessel (i.e., the difference between the pressures at the inlet and outlet of a vessel will increase as fouling occurs). In any event, depositing a first fouling substance originating from a first fouling fluid on at least a portion of the interior surface of the first pressurized vessel results in a fouled first pressurized vessel having a second pressure at the first position (even if the second pressure is substantially the same as the first pressure). Similarly, in embodiments where a second pressurized vessel is employed in the method (e.g., in which multiple pressurized vessels are employed), depositing a second fouling substance originating from a second fouling fluid on at least a portion of the interior surface of the second pressurized vessel results in a fouled second pressurized vessel having a sixth pressure at the second position. In these embodiments, the pressures are measured relative to a specific position within (i.e., inside) the pressurized and fouled pressurized vessels (which are the same physical vessel, but one is fouled and one is substantially not fouled).

In certain embodiments, the step of rapidly changing the second pressure to the third pressure in a fouled first pressurized vessel (or rapidly changing the sixth pressure to the seventh pressure in a fouled second pressurized vessel) occurs in a first time period of 30 sec, 25 sec, 20 sec, 15 sec, 14 sec, 13 sec, 12 sec, 11 sec, 10 sec, 9.5 sec 9 sec, 8.5 sec, 8 sec, 7.5 sec, 7 sec, 6.5 sec, 6 sec, 5.5 sec, 5 sec, 4.5 sec, 4 sec, 3.5 sec, 3 sec, 2.5 sec, 2 sec, 1.5 sec, 1 sec, 0.5 sec, or 0.2 sec. Each of the foregoing numbers can be preceded by the term "about," "at least about," or "less than about," and any of the foregoing numbers can be used singly to describe an open-ended range or in combination to describe a close-ended range. In some embodiments, the rapid change in pressure occurs in a time period of less than about 10 sec. In some embodiments, the change in pressure occurs in a time period of about 1 sec to about 5 sec. The rapid pressure changes disclosed herein are measured relative to a single section or point within the vessel (typically, upstream of the valve that caused the rapid pressure change). In some embodiments, the third pressure is different from the second pressure by at least about 20% of the second pressure (or any other pressure difference as described elsewhere herein), and the first time period described in this paragraph is the time required to reach this pressure difference. In some embodiments, the first time period can be considered the duration of the rapid pressure change step (e.g., the time it takes to reach the third pressure from the second pressure). In some embodiments, this time elapsed can be considered the duration of the "blow out." In some embodiments, it is desirable to strike a balance between performing the "blow out" for a duration that sufficiently removes the fouling substance that enables proper operation of the system (e.g., hydrothermal hydrolysis of biomass), while at the same time minimizing the "shock" that the system experiences by such a "blow out." The "blow out" corresponds to the rapid pressure changing step, which can be either an increase or a decrease in pressure.

In some embodiments, the fouling fluid, the fluid (if present), or a mixture thereof is in a state selected from the group consisting of a supercritical state, a near-critical state, a saturated state, and a subcooled state upon commencing the rapid changing step from the second pressure or sixth pressure to the third pressure or seventh pressure, respectively.

In some embodiments, the first pressure is 800 psia, 1000 psia, 1200 psia, 1400 psia, 1600 psia, 1800 psia, 2000 psia, 2200 psia, 2400 psia, 2600 psia, 2800 psia, 2900 psia, 3000 psia, 3100 psia, 3200 psia, 3300 psia, 3400 psia, 3500 psia, 3600 psia, 3800 psia, 4000 psia, 4200 psia, 4400 psia, 4600 psia, 4800 psia, 5000 psia, 5200 psia, 5400 psia, 5600 psia, 5800 psia, or 6000 psia. Each of the foregoing numbers can be preceded by the term "about," "at least about," or "less than about," and any of the foregoing numbers can be used singly to describe an open-ended range or in combination to describe a close-ended range. Any of the foregoing pressures specified for the first pressure (in the context of the first pressurized vessel) also independently apply to the fifth pressure (in the context of the second pressurized vessel). If additional pressurized vessels are employed, e.g., a third, fourth, fifth, or sixth pressurized vessel, the pressures specified for the first pressure independently apply to those pressurized vessels as well.

In some embodiments, the second pressure can be independently selected from any of the pressures specified for the first pressure. The second pressure is the pressure of the fouled pressurized vessel upon commencing the rapid pressure changing step. Typically, the second pressure is lower than the first pressure, assuming all other variables are kept constant (such as slurry inlet pressure). For example, the first pressure can be 3200 psia, and the second pressure can be 3100 psia. Typically, as a fouling substance is deposited on the interior surface of the pressurized vessel, the pressure of the pressurized vessel gradually decreases. However, embodiments are contemplated in which such pressure reduction due to fouling does not occur; for example, the system may be modulated in such a way that any pressure reductions that would occur due to fouling are compensated for by a roughly equal pressure increase in the system, such that the observed pressure of the system stays substantially the same. In some embodiments, the rapid pressure change is performed prior to any noticeable changes in pressure of the fouled pressurized vessel. Accordingly, in some embodiments, the first pressure and the second pressure are substantially the same. In some embodiments, the second pressure differs from the first pressure by 1%, 2%, 3%, 4%, 5%, 6%, 7%, 8%, 9%, 10%, 11%, 12%, 13%, 14%, 15%, 16%, 17%, 18%, 19%, or 20%. Each of the foregoing numbers can be preceded by the term "about," "at least about," or "less than about," and any of the foregoing numbers can be used singly to describe an open-ended range or in combination to describe a close-ended range. If a second pressurized vessel is employed, then the first pressure of the first pressurized vessel is comparable to (but independent from) the fifth pressure of the second pressurized vessel, and the second pressure of the fouled first pressurized vessel is comparable to (but independent from) the sixth pressure of the fouled second pressurized vessel.

In some embodiments, upon commencing the rapid pressure change from the second pressure to the third pressure (or the sixth pressure to the seventh pressure), the first fouling fluid (or the first fluid if used in the displacing step, or a mixture thereof) has a temperature of 140° C., 160° C., 180° C., 200° C., 220° C., 240° C., 260° C., 280° C., 300° C., 320° C., 340° C., 360° C., 380° C., 400° C., 420° C., 440° C., 450° C., 460° C., 480° C., 500° C., 520° C., 540° C., 560° C., 580° C., 600° C., 700° C., 800° C., 900° C., or 1000° C. Each of the foregoing numbers can be preceded by the term "about," "at least about," or "less than about," and any of the foregoing numbers can be used singly to describe an open-ended range or in combination to describe a close-ended range. In some embodiments the temperature is at least about 140° C. In some embodiments, the temperature is at least about 340° C. In some embodiments, the temperature is at least about 370° C. The temperature is not particularly limited, provided that the pressure in the pressurized vessel is sufficiently high such that a rapid pressure change can remove a fouling substance deposited on (e.g., adhered to) the interior surface of the pressurized vessel. Any of the foregoing temperatures recited for the first fouling fluid also independently apply to the second fouling fluid, in the event a second pressurized reactor is employed. Any of the temperatures disclosed herein for the fouling fluid can equally but independently apply to the fluid used in a displacing step.

In some embodiments, the third pressure is different from the second pressure by 20%, 25%, 30%, 35%, 40%, 45%, 50%, 55%, 60%, 65%, 70%, 75%, 80%, 85%, 90%, 95%, or 100% of the second pressure. Each of the foregoing numbers can be preceded by the term "about," "at least about," or "less than about," and any of the foregoing numbers can be used singly to describe an open-ended range or in combination to describe a close-ended range. If a second pressurized vessel is employed, then the third pressure in relation to the first pressurized vessel is comparable to (but independent from) the seventh pressure in relation to the second pressurized vessel (which is true for any embodiment herein). In some embodiments, the third pressure is different from the second pressure by at least about 20% of the second pressure.

In some embodiments, the methods disclosed herein further comprise adjusting the third pressure to a fourth pressure. In some embodiments, this adjusting step returns the pressure of the system (e.g., of the pressurized vessel) to a pressure that is near the second pressure (or the first pressure since, in some embodiments, the first and second pressure can be the same or substantially similar). In some embodiments, the fourth pressure is within 1%, 5%, 10%, 15%, 20%, 25%, 30%, 35%, 40%, 45%, or 50% of the second pressure (or the first pressure). Each of the foregoing numbers can be preceded by the term "about" or "at least about." In some embodiments, the fourth pressure is within about 20% of the second pressure. In some embodiments, the third pressure is different from the second pressure by at least about 20% of the second pressure (or any of the pressure differences disclosed elsewhere herein), and the method further comprises adjusting the third pressure to a fourth pressure, wherein the fourth pressure is within about 20% of the second pressure (or any of the pressure differences recited in this paragraph). In some embodiments, this adjusting step can be considered resumption of the process after the rapid pressure change in the system has removed at least a portion (e.g., a significant portion) of the fouling substance deposited on the interior surface of the fouled pressurized vessel. In some embodiments, the rapid pressure changing step is performed by quickly opening a valve in the system to rapidly let down the pressure, and the adjusting step is performed by closing this valve to substantially return (e.g., increase) the pressure to the operating pressure of the system. In some embodiments, the rapid pressure changing step is performed by quickly closing a valve in the system to rapidly increase the pressure, and the adjusting step is performed by opening this valve to substantially return (e.g., decrease) the pressure to the operating pressure of the system. In some embodiments, both a pressure increase and decrease are achieved when closing a valve. Multiple valves may be employed to achieve the desired rapid change of pressure, and any known valve in the art may be employed provided the desired rapid pressure change can be achieved with such valve.

In some embodiments, when adjusting the third pressure to the fourth pressure, the fourth pressure is achieved in a time period of 3 sec, 5 sec, 7 sec, 10 sec, 15 sec, 20 sec, 25 sec, 30 sec, 35 sec, 40 sec, 45 sec, 50 sec, 55 sec, 60 sec, 1 min, 1.2 min, 1.4 min, 1.6 min, 1.8 min, 2 min, 2.5 min, 3 min, 3.5 min, 4 min, 4.5 min, 5 min, 5.5 min, 6 min, 6.5 min, 7 min, 7.5 min, 8 min, 8.5 min, 9 min, 9.5 min, or 10 min. Each of the foregoing numbers can be preceded by the term "about," "at least about," or "less than about," and any of the foregoing numbers can be used singly to describe an open-ended range or in combination to describe a close-ended range. In some embodiments, the fourth pressure is within a specified percentage of the second (or first) pressure, as described elsewhere herein. The time period in this context is measured from the time that the valve is closed, until the time that a specified pressure (e.g., the fourth pressure) is reached.

In some embodiments, the third pressure is adjusted relatively quickly to the fourth pressure (in a time period specified herein above), and the fourth pressure is then further adjusted to an eighth pressure in a relatively slower time period. For example, after performing the rapid pressure change from the second pressure (e.g., 3300 psia) to the third pressure (e.g., 900 psia), the system is adjusted to the fourth pressure in a relatively quick period of time (e.g., about 3 sec to about 10 sec), and then the system is further adjusted to an eighth pressure in a relatively slower time period (e.g., about 60 sec to about 5 min). In such embodiments, the fourth pressure is an acceptable intermediate pressure that is achieved relatively quickly to bring the system "close" to operating pressure (e.g., within a certain percentage as described elsewhere herein), and then the fourth pressure is gradually adjusted to the eighth pressure, which represents the system taking some time to achieve a steady state (or which simply represents the manner in which the system is intentionally controlled). In some embodiments, the time period to achieve the eighth pressure from the fourth pressure is 30 sec, 35 sec, 40 sec, 45 sec, 50 sec, 55 sec, 60 sec, 1 min, 1.2 min, 1.4 min, 1.6 min, 1.8 min, 2 min, 2.5 min, 3 min, 3.5 min, 4 min, 4.5 min, 5 min, 5.5 min, 6 min, 6.5 min, 7 min, 7.5 min, 8 min, 8.5 min, 9 min, 9.5 min, 10 min, 12 min, 14 min, 16 min, 18 min, or 20 min. Each of the foregoing numbers can be preceded by the term "about," "at least about," or "less than about," and any of the foregoing numbers can be used singly to describe an open-ended range or in combination to describe a close-ended range. The eighth pressure can be within 1%, 5%, 10%, 15%, 20%, or 25% of the second pressure (or the first pressure). Each of the foregoing numbers can be preceded by the term "about." In some embodiments, this acceptable intermediate pressure is a pressure at which the normal process can operate (e.g., hydrolyzing biomass), and as a result such normal processing can resume at this point, even while the pressure continues to gradually adjusted from the fourth pressure to the eighth pressure.

In some embodiments, the contacting, depositing, optional displacing, rapid changing, and adjusting steps are performed while maintaining a pressure of 500 psia, 600 psia, 700 psia, 800 psia, 900 psia, 1000 psia, 1100 psia, 1200 psia, 1400 psia, 1600 psia, 1700 psia, 1800 psia, 1900 psia, 2000 psia, 2100 psia, 2200 psia, 2400 psia, 2600 psia, 2800 psia, 3000 psia, 3100 psia, 3200 psia, 3300 psia, 3400 psia, 3600 psia, 3800 psia, 4000 psia, 4200 psia, 4400 psia, 4600 psia, 4800 psia, 5000 psia, 5200 psia, 5400 psia, 5600 psia, 5800 psia, or 6000 psia. Each of the foregoing numbers can be preceded by the term "about," "at least about," or "less than about," and any of the foregoing numbers can be used singly to describe an open-ended range or in combination to describe a close-ended range. In some embodiments, the contacting, depositing, optional displacing, rapid changing, and adjusting steps are performed while maintaining a pressure of at least about 900 psia (e.g., at least about 1000 psia or at least about 2200 psia). In some embodiments, each of these steps is sequential. As used herein, "while maintaining a pressure" means that the pressure does not change from (e.g. drop below or exceed) the specified pressure or pressure range. For example, in some embodiments, the contacting, depositing, optional displacing, rapid changing, and adjusting steps are performed while maintaining a pressure of at least about 500 psia, and this means that the pressure does not fall below about 500 psia (or any of the other pressures or pressure ranges disclosed herein) throughout the entirety of the contacting, depositing, optional displacing, rapid changing, and adjusting steps. In some embodiments, the contacting, depositing, optional displacing, rapid changing, and adjusting steps are performed (optionally sequentially), and the method is repeated at least once, while maintaining a pressure or pressure range specified in this paragraph (e.g., at least about 900 psia). In some embodiments, the displacing step is performed and the method is repeated, but in the repeating the displacing step is not performed. Alternatively, in some embodiments, the method is performed without the displacing step, the method is repeated, and when repeating the method the displacing step is performed.

In some embodiments, the method includes an adjusting step as disclosed elsewhere herein, and the method is repeated at least once, in which the fourth pressure or eight pressure (resulting from the adjusting step) is considered to be the first pressure when repeating the method, even if the fourth pressure in the adjusting is different from the first pressure prior to the rapid pressure change step. In some embodiments, a time period elapses between subsequent rapid pressure changing steps when the method is repeated, in which the time period is 20 sec, 40 sec, 60 sec, 80 sec, 100 sec, 2 min, 4 min, 8 min, 10 min, 15 min, 20 min, 25 min, 30 min, 35 min, 40 min, 45 min, 50 min, 55 min, 60 min, 65 min, 70 min, 75 min, 80 min, 85 min, 90 min, 95 min, 100 min, 105 min, 110 min, 115 min, 120 min, 125 min, 130 min, 135 min, 140 min, 145 min, 150 min, 155 min, or 160 min. Each of the foregoing numbers can be preceded by the term "about," "at least about," or "less than about," and any of the foregoing numbers can be used singly to describe an open-ended range or in combination to describe a close-ended range.

In some embodiments, a rapid pressure change should ideally take place once a predetermined pressure drop (or pressure drop range) across the vessel (e.g., tubular reactor) is reached, once a predetermined temperature (or temperature range) of the outer wall of the vessel is reached, at a predetermined time interval (or time interval range) (as disclosed elsewhere herein), or any combination thereof. As used herein, "pressure drop" is the difference in pressure at the inlet and outlet of a vessel (e.g., tubular reactor), which is expressed herein as a percent change (as measured at the outlet) relative to the pressure at the inlet of the vessel. For example, a rapid pressure change can be performed when the pressure drop is 0%, 1%, 2%, 3%, 4%, 5%, 6%, 7%, 8%, 9%, 10%, 11%, 12%, 13%, 14%, 15%, 16%, 17%, 18%, 19%, or 20%. Each of the foregoing numbers can be preceded by the term "about," "at least about," or "less than about," and any of the foregoing numbers can be used singly to describe an open-ended range or in combination to describe a close-ended range. For example, if the inlet pressure is 3400 psia, and the outlet pressure is 3300 psia, the pressure drop is about 3%. Alternatively, or in addition, a rapid pressure change can be performed when the outer wall of the reactor/vessel reaches a specified temperature. The thermal energy of the reactor/vessel wall is derived from the thermal energy of the slurry (e.g., fouling fluid) flowing through the reactor/vessel, unless additional heating means are employed (e.g., electrical heating, hot fluid heating, hot air heating, etc.). As fouling substance is deposited on the interior surface of the reactor/vessel, the outer wall of the vessel effectively becomes insulated from the slurry, which causes an observable decrease in temperature at the outer surface of the reactor wall. Even if additional heating means are employed, the insulating effect of the fouling building can be implied through either a drop in temperature or an increased compensation by the additional heating means. A rapid pressure change can be performed when the outer surface of the reactor wall deviates from the temperature of the reactor wall during normal operating conditions (and before significant fouling substance is deposited on the interior surface) by 0%, 1%, 2%, 3%, 4%, 5%, 6%, 7%, 8%, 9%, 10%, 11%, 12%, 13%, 14%, 15%, 16%, 17%, 18%, 19%, or 20% (accounting for any impacts of additional heating means, if present). Each of the foregoing numbers can be preceded by the term "about," "at least about," or "less than about," and any of the foregoing numbers can be used singly to describe an open-ended range or in combination to describe a close-ended range.

In some embodiments, the method is continuous without any substantial interruptions to the normal operation of the system. The duration of the rapid pressure changing step typically is less than about 30 sec, and the rapid pressure changing step is not considered to be a substantial interruption. In some embodiments, the method is continuous for 12 hrs, 24 hrs, 36 hrs, 48 hrs, 60 hrs, 72 hrs, 84 hrs, 96 hrs, 108 hrs, 120 hrs, 140 hrs, 160 hrs, 180 hrs, 200 hrs, 250 hrs, 300 hrs, 350 hrs, 400 hrs, 450 hrs, 500 hrs, 550 hrs, 600 hrs, 650 hrs, 700 hrs, 750 hrs, 800 hrs, 850 hrs, 900 hrs, 950 hrs, or 1000 hrs without any substantial interruption, and the method is repeated with an elapsed time period between rapid pressure changing steps, as described elsewhere herein. Each of the foregoing numbers can be preceded by the term "about," "at least about," or "less than about," and any of the foregoing numbers can be used singly to describe an open-ended range or in combination to describe a close-ended range. Such methods sometimes include systems with a single source of fouling fluid and a single reactor, as well as systems with multiple sources of fouling fluid, multiple reactors, and combinations thereof. The method may be continuous with respect to a single vessel, or the method may be continuous when employing multiple vessels.

In some embodiments, the optional displacing step is performed. In some embodiments, the fluid (e.g., first fluid, second fluid, or both) comprises water. In some embodiments, the fluid consists essentially of water. In some embodiments, the fluid consists of water. In some embodiments, the fluid comprises, consists or, or consists essentially of hot compressed water. In some embodiments, the fluid comprises, consists of, or consists essentially of supercritical water.

In some embodiments, the optional displacing step is performed, and the fouling fluid is at a pressure that is the same as or different from the pressure of the fluid (i.e., the fluid that does the displacing). In some embodiments, the fouling fluid is at a temperature that is the same as or different from the temperature of the fluid. Additionally, in some embodiments, the fouled pressurized vessel is not substantially depressurized during the displacing. For example, the fouled pressurized vessel is within 75%, 80%, 85%, 90%, or 95% of the pressure of the fouled pressurized vessel immediately prior to the displacing step. In the event that the displacing step is performed, and the pressure of the system changes during the displacing step, the pressure of the system upon commencement of the rapid pressure changing step is considered the "second pressure" (or the "sixth pressure" in the event a second pressurized vessel is employed). In some embodiments, the temperature of the fouling fluid can be about 360° C. to about 420° C. (or any of the other temperatures or temperature ranges disclosed elsewhere herein for the fouling fluid), and the temperature of the fluid in the displacing step can be about 360° C. to about 450° C. (or any of the other temperatures or temperature ranges disclosed elsewhere herein for the fluid). In some embodiments, the temperature of the fouling fluid and the fluid are substantially the same (e.g., within about 2% of one another).

In some embodiments, the rapid changing step results in the third pressure being different from the second pressure by at least about 20% of the second pressure (or any other difference as described elsewhere herein). In some embodiments, the method further comprises:

adjusting the third pressure to within about 20% of the second pressure (wherein the third pressure may be above or below the second pressure); and supplanting the first fluid with a third fouling fluid that can be the same or different from the first fouling fluid.

In some embodiments, the method can be repeated at least once, and the third fouling fluid can be considered the first fouling fluid in the repeating. In some embodiments, the rapid changing, adjusting, and supplanting steps are carried out in a time period of less than about 120 seconds, preferably less than about 90 seconds, and even more preferably less than about 60 seconds, as measured from the point in time when the rapid changing commences until the supplanting step is finished (at which point the repeating of the method begins).

In some embodiments, the method does not employ an exogenous compound in an amount effective to remove a substantial portion of the fouling substance deposited on the interior surface of the fouled first pressurized vessel, wherein the exogenous compound is selected from the group consisting of an acid, a base, an organic solvent (e.g., methanol, ethanol, propanol, acetone, ethyl acetate, etc.), and a combination thereof. As used in this context, the phrase "an amount effective to" refers to an amount of an exogenous compound that is effective to remove a substantial portion of the fouling substance through its own action without the rapid pressure change. In some embodiments, however, exogenous compound (as disclosed above) can be added to the fouling fluid, fluid, or both, to enhance the effects of the method (e.g. rapid pressure change).

In some embodiments, a solid exogenous compound is added during the method to enhance the scouring on the interior surface of the fouled pressurized vessel. In some embodiments, at least one solid is added to the fouling fluid, the fluid if present, or a mixture thereof prior to or during the rapid changing step, wherein the at least one solid is selected from the group consisting of a powder, metal (in the form of beads, polygonal shapes, amorphous shapes, shavings, and the like, for example), magnetic metal (in the form of beads or filings, for example), cellulose, microcrystalline cellulose, nanocrystalline cellulose, sand, inorganic material (such as metal oxides, such as silicon dioxide), biomass, insoluble $C_5$ saccharides (including oligomeric and/or polymeric forms), insoluble $C_6$ saccharides (including oligomeric and/or polymeric forms), lignin, and combinations thereof. The added solid may be any solid that removes the fouled substance while causing no or minimal damage to the interior surface of the pressurized vessel. In some embodiments, the added solid is a compound that can break down into desired products of the process, for example, cellulose or starch that can break down into glucose and glucooligosaccharides (which in some embodiments may be desirable products).

In some embodiments, the first fouling fluid, the first fluid (if present), or a mixture thereof is transported continuously. As used herein, "transporting continuously" means that throughout the method, including contacting, depositing, displacing (if employed), and rapid changing, the indicated fluid(s) is (are) continuously transported (e.g., pumped, screw fed, etc.) through the vessel. For example, when transported continuously, the indicated fluid or fluids do not cease to be transported through the vessel from the contacting step through the rapid changing step. In some embodiments, if the method is repeated, the fluid is transported continuously throughout the method and the repeated method (i.e., the fluid does not cease to be transported through the vessel throughout all of these steps). As used in this context, the phrase "transported continuously" does not include stirring in a tank.

In some embodiments, the fouling fluid, the fluid (if present), or a mixture thereof is in turbulent flow during the depositing step. In some embodiments, the flow of the fouling fluid is laminar during the depositing step. In some embodiments, the flow of the fouling fluid is not laminar during the depositing step.

In some embodiments, the velocity at the center of a vessel and at the wall (interior surface) of the vessel may be different. If there is a difference between such velocities, it is preferable to measure the velocity at the wall of the vessel.

In some embodiments, the third velocity is different from the second velocity by a factor "X" of 1.1, 1.3, 1.5, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19, 20, 22, 24, 26, 8, 30, 32, 34, 36, 38, 40, 42, 44, 46, 48, or 50. Each of the foregoing numbers can be preceded by the term "about," "at least about," or "less than about," and any of the foregoing numbers can be used singly to describe an open-ended range or in combination to describe a close-ended range. Typically, the third velocity is greater than the second velocity, such that the third velocity is X times the second velocity (e.g., at least about X times the first velocity). For example, if the second velocity is 2 m/s, the third velocity can be 2×m/s (e.g., at least about 2×m/s), where X can be any of the numerical factors disclosed herein. If a second pressurized vessel is employed, then the second and third velocities of the first pressurized vessel are comparable to (but independent from) the fifth and sixth velocities of the second pressurized vessel, respectively.

In some embodiments, the first velocity (or fourth velocity, independently) is 0.2 m/s, 0.4 m/s, 0.6 m/s, 0.8 m/s, 1 m/s, 1.2 m/s, 1.4 m/s, 1.6 m/s, 1.8 m/s, 2 m/s, 2.5 m/s, 3 m/s, 3.5 m/s, 4 m/s, 4.5 m/s, 5 m/s, 6 m/s, 7 m/s, 8 m/s, 9 m/s, 10 m/s, 15 m/s, or 20 m/s. Each of the foregoing numbers can be preceded by the term "about," "at least about," or "less than about," and any of the foregoing numbers can be used singly to describe an open-ended range or in combination to describe a close-ended range.

As the pressurized vessel fouls (i.e., as a fouling substance is deposited on an interior surface thereof, thereby forming a fouled pressurized vessel), the velocity of the fluid flowing therein may change slightly as a consequence of the constricted flow path due to fouling. If the methods disclosed herein are performed as described, the fouling substance is removed prior to any significant buildup, such that the velocity of the fluid flowing in the fouled pressurized vessel should not differ in a significant way from the velocity of the fluid flowing in the pressurized vessel (before depositing the fouling substance thereon). As used herein, the "second velocity" is the velocity of a fluid flowing in the fouled first pressurized vessel as measured relative to a specific position inside the vessel, and, in the event a second pressurized vessel is employed in the method, the "fifth velocity" is the velocity of a fluid flowing in the fouled second pressurized vessel as measured relative to a specific position inside the vessel. Typically, the second and fifth velocities are the velocities of the indicated fluid(s) upon commencement of the rapid pressure change in the respective vessel. Any of the velocities disclosed herein for the first velocity can independent apply to the second, fourth, and fifth velocities.

In some embodiments, the third velocity (or sixth velocity, independently) is 3 m/s, 3.5 m/s, 4 m/s, 4.5 m/s, 5 m/s, 6 m/s, 7 m/s, 8 m/s, 9 m/s, 10 m/s, 15 m/s, 20 m/s 25 m/s 30 m/s 35 m/s 40 m/s 45 m/s, 50 m/s, 55 m/s, 60 m/s, 65 m/s, 70 m/s, 75 m/s, 80 m/s, 85 m/s, 90 m/s, 95 m/s, or 100 m/s. Each of the foregoing numbers can be preceded by the term "about," "at least about," or "less than about," and any of the foregoing numbers can be used singly to describe an open-ended range or in combination to describe a close-ended range.

In some embodiments, the second velocity (or fifth velocity, independently) changes to the third velocity (or sixth velocity, independently) at an acceleration of 0.1 $m/s^2$, 0.2 $m/s^2$, 0.3 $m/s^2$, 0.4 $m/s^2$, 0.5 $m/s^2$, 0.6 $m/s^2$, 0.7 $m/s^2$, 0.8 $m/s^2$, 0.9 $m/s^2$, 1 $m/s^2$, 1.2 $m/s^2$, 1.4 $m/s^2$, 1.6 $m/s^2$, 1.8 $m/s^2$, 2 $m/s^2$, 3 $m/s^2$, 4 $m/s^2$, 5 $m/s^2$, 6 $m/s^2$, 7 $m/s^2$, 8 $m/s^2$, 9 $m/s^2$, or 10 $m/s^2$. Each of the foregoing numbers can be preceded by the term "about," "at least about," or "less than about," and any of the foregoing numbers can be used singly to describe an open-ended range or in combination to describe a close-ended range.

In some embodiments, the second pressure is changed to the third pressure at a rate of 100 psi/sec, 125 psi/sec, 150 psi/sec, 175 psi/sec, 200 psi/sec, 225 psi/sec, 250 psi/sec, 275 psi/sec, 300 psi/sec, 325 psi/sec, 350 psi/sec, 375 psi/sec, 400 psi/sec, 425 psi/sec, 450 psi/sec, 475 psi/sec, 500 psi/sec, 550 psi/sec, 600 psi/sec, 650 psi/sec, 700 psi/sec, 750 psi/sec, 800 psi/sec, 850 psi/sec, 900 psi/sec, 950 psi/sec, 1000 psi/sec, 1100 psi/sec, 1200 psi/sec, 1300 psi/sec, 1400 psi/sec, 1500 psi/sec, 1600 psi/sec, 1700 psi/sec, 1800 psi/sec, 1900 psi/sec, 2000 psi/sec, 2100 psi/sec, 2200 psi/sec, 2300 psi/sec, 2400 psi/sec, 2500 psi/sec, 2600 psi/sec, 2700 psi/sec, 2800 psi/sec, 2900 psi/sec, 3000 psi/sec, 3200 psi/sec, 3400 psi/sec, 3600 psi/sec, 3800 psi/sec, or 4000 psi/sec. Each of the foregoing numbers can be preceded by the term "about," "at least about," or "less than about," and any of the foregoing numbers can be used singly to describe an open-ended range or in combination to describe a close-ended range. If a second pressurized vessel is employed, then the second and third pressures relative to the (fouled) first pressurized vessel are comparable to (but independent from) the sixth and seventh pressures of the (fouled) second pressurized vessel, respectively. While the rate of pressure change can change throughout the duration of the rapid pressure changing step (e.g., via exponential decay), the rates described herein correspond to the peak rate during the pressure changing step. In some embodiments, the rate of pressure change is maintained above a certain level (e.g., any of the levels specified above, such as at least 1000 psi/sec) for the duration of rapid pressure change step (disclosed elsewhere herein), or only for a portion thereof (e.g., 5%, 10%, 15%, 20%, 25%, 30%, 35%, 40%, 45%, 50%, 55%, 60%, 65%, 70%, 75%, 80%, 85%, 90%, or 95% of the duration). For example, the rapid pressure changing step can occur in about 3 sec, and the rapid of pressure change may be maintained above about 1600 psi/sec for the entire duration of 3 sec, or for only 1.5 sec (e.g., during the time from 1.5 sec to 3 sec the rate of pressure change is less than 1600 psi/sec). Peak rate of pressure change should be determined by collecting pressure data at least every 0.5 sec (e.g., at least every 0.4 sec, 0.3 sec, 0.2, sec, or 0.1 sec) during a rapid pressure change. This more frequent data collection ensures the generated curve accurately depicts the peak rate of pressure change.

In certain embodiments, the step of rapidly changing the second (or sixth) pressure to the third (or seventh) pressure comprises a decrease in pressure. The decrease in pressure can result in a decrease in density of the fouling fluid, fluid (if present), or a mixture thereof. In some embodiments, at least a portion of the first fouling fluid, the first fluid (if present), or a mixture thereof is vaporized (in addition to experiencing the density decrease), when rapidly decreasing the second (or sixth) pressure to the third (or seventh) pressure. In some embodiments, the step of rapidly changing the second (or sixth) pressure to the third (or seventh) pressure comprises an increase in pressure. The increase in pressure can result in an increase in density. Any of the descriptions herein also apply equally, but independently, to a second pressurized vessel, if employed.

In some embodiments, the step of displacing, rapid changing, or both comprises supplying a first hot compressed fluid, such as supercritical water, from a supercritical water heater or tank.

In some embodiments, the first pressure and second are maintained using a first valve, and rapidly changing the second pressure to the third pressure occurs by opening a second valve that is different from the first valve. In some embodiments, the first pressure and second pressure are maintained using a first valve, and rapidly changing the second pressure to the third pressure occurs by opening a second valve while substantially simultaneously closing the first valve, in which the first and second valves are different valves. In some embodiments, the first pressure and second pressure are maintained using a first valve, and rapidly changing the second pressure to the third pressure occurs by further opening the first valve.

The shape or geometry of the vessel (e.g., pressurized vessel) employed in the methods herein is not particularly limited. The shape or geometry typically is such that performing the method disclosed herein is sufficient to remove fouling substance adhered on the interior surface of the vessel (and/or fused/interlocked fouling substance as described elsewhere herein). In some embodiments, the vessel is tubular, has polygonal-shaped walls, is cylindrical-shaped, is conical (e.g., a cyclone), or any combination thereof. In some embodiments, the vessel is composed of multiple parts, e.g., a tubular section and a conical section (such as a cyclone). In some embodiments, the vessel is a batch vessel (e.g., a valve can be opened and the interior of the vessel can experience a rapid pressure change, and in some embodiments the material/fouling fluid inside the batch vessel can achieve a higher velocity upon opening the valve). In some embodiments, the vessel is a tubular vessel. In some embodiments, the interior surface of the vessel has a coating that, e.g., prevents fouling and/or aids in releasing material during the performance of the method. In some embodiments, the interior of the vessel has protrusions that create turbulent flow to aid mixing (which protrusions and interior surface of the vessel are cleaned by the methods herein).

Some of the embodiments herein have been described with reference to a single pressurized vessel, and, in some embodiments, a single source of pressurized fluid. It is contemplated that the methods and systems may include multiple vessels, multiple sources of pressurized fluid, and combinations thereof. For example, it is contemplated that multiple vessels (such as tubular reactors) may be used with multiple sources of pressurized fluid, where the vessels are operated in parallel with the same or different conditions, and the method is carried out independently in each vessel, as needed. In addition, it is contemplated that multiple vessels (such as tubular reactors) may be used with a single source of pressurized fluid (such as a supercritical water heater/tank), where the vessels are run in parallel but the method is carried out individually, as needed, using the common source of pressurized fluid. It is also contemplated that multiple sources of pressurized fluid (such as supercritical water heater or tank) may be used with a single vessel or multiple vessels.

Accordingly, in some embodiments, the methods disclosed herein further comprise:

providing a second pressurized vessel having an interior surface;

contacting the interior surface of the second pressurized vessel with a second fouling fluid;

wherein:

the second fouling fluid has a composition that is the same as or different from a composition of the first fouling fluid;

the second pressurized vessel has a fifth pressure at a second position inside the second pressurized vessel; and the second fouling fluid has a fourth velocity at the second position;

depositing a second fouling substance originating from the second fouling fluid on at least a portion of the interior surface of the second pressurized vessel, thereby forming a fouled second pressurized vessel having a sixth pressure at the second position and a fifth velocity at the second position;

wherein the second fouling substance is the same as or different from the first fouling substance;

optionally, displacing at least a portion of the second fouling fluid contained in the fouled second pressurized vessel with second fluid that is different from the second fouling fluid; and rapidly changing the sixth pressure of the second fouled pressurized vessel to a seventh pressure, thereby causing the second fouling fluid, the second fluid if present, or a mixture thereof within the fouled second pressurized vessel to achieve a sixth velocity at the second position, wherein the sixth velocity is greater than the fifth velocity;

wherein the process removes a portion of the second fouling substance deposited on the interior surface of the fouled second pressurized vessel.

In some embodiments employing a second pressurized vessel, displacing at least a portion of the second fouling fluid contained in the fouled second pressurized vessel with second fluid that is different from the second fouling fluid is performed, and the second fluid comprises, consists of, or consists essentially of hot compressed water. In some embodiments, the hot compressed water is supercritical water. In some embodiments, the second fluid comprises, consists of, or consists essentially of supercritical water.

In some embodiments employing a second pressurized vessel, depositing the second fouling substance on at least a portion of the interior surface of the second pressurized vessel is performed at substantially the same time as rapidly changing the second pressure to a third pressure within the fouled first pressurized vessel. As used in this context, "at substantially the same time" means that these features can be performed at the same time, or within 5 min, 4 min, 3 min, 2 min, 1 min, 45 sec, 30 sec, 15 sec, 10 sec, 5 sec, or 1 sec. Each of the foregoing numbers can be preceded by the term "about," "at least about," or "less than about," and any of the foregoing numbers can be used singly to describe an open-ended range or in combination to describe a close-ended range.

In some embodiments employing a second pressurized vessel, the second fouling fluid has a temperature of at least about 340° C. (or any of the other temperatures disclosed elsewhere herein) upon commencing the rapid change from the sixth pressure to the seventh pressure.

Some embodiments of the methods disclosed herein are set forth in the following clauses, and any combination of these clauses (or portions thereof) may be made to define an embodiment of the methods disclosed herein.

Clause 1: A method comprising: providing a first pressurized vessel having an interior surface; contacting the interior surface of the first pressurized vessel with a first fouling fluid; wherein: the first pressurized vessel has a first pressure at a first position inside the first pressurized vessel; and the first fouling fluid has a first velocity at the first position; depositing a first fouling substance originating from the first fouling fluid on at least a portion of the interior surface of the first pressurized vessel, thereby forming a fouled first pressurized vessel having a second pressure at the first position, wherein the first fouling fluid has a second velocity at the first position; optionally, displacing at least a portion of the first fouling fluid contained in the fouled first pressurized vessel with a first fluid that is different from the first fouling fluid; and rapidly changing the second pressure to a third pressure, thereby causing the first fouling fluid, the first fluid if present, or a mixture thereof within the fouled first pressurized vessel to achieve a third velocity at the first position, wherein the third velocity is greater than the second velocity; wherein the method removes a portion of the first fouling substance deposited on the interior surface of the fouled first pressurized vessel.

Clause 2: The method of clause 1, wherein the method removes a substantial portion of the first fouling substance deposited on the interior surface of the fouled first pressurized vessel.

Clause 3: The method of clause 1 or 2, wherein the third pressure is different from the second pressure by at least about 20% of the second pressure.

Clause 4: The method of any one of clauses 1-3, wherein changing the second pressure to the third pressure occurs in a first time period of less than about 10 sec.

Clause 5: The method of any one of clauses 1-4, wherein, the first fouling fluid, the first fluid if present, or a mixture thereof is in a state selected from the group consisting of a supercritical state, a near-critical state, a saturated state, and a subcooled state immediately prior to rapidly changing the second pressure to the third pressure.

Clause 6: The method of any one of clauses 1-5, wherein the first pressure is at least about 1000 psia.

Clause 7: The method of any one of clauses 1-6, wherein the first fouling fluid has a temperature of at least about 140° C. upon commencing the rapid change from the second pressure to the third pressure.

Clause 8: The method of any one of clauses 1-7, wherein the first fouling fluid has a temperature of at least about 340° C. upon commencing the rapid change from the second pressure to the third pressure.

Clause 9: The method of any one of clauses 1-8, wherein the first fouling fluid comprises a material selected from the group consisting of biomass, municipal waste, fractionated biomass, hemicellulose, cellulose, cello-oligosaccharides, glucose, xylan, xylo-oligosaccharides, xylose, C6 oligosaccharides, C5 oligosaccharides, C6 monosaccharides, C5 monosaccharides, lignin, starch, lipids, proteins, polypeptides, polymers, oligomers, furfural, hydroxymethyl furfural, and any combination thereof.

Clause 10: The method of any one of clauses 1-9, wherein the first fouling substance is selected from the group consisting of an organic material, lignin, a polyfuran, a humin, char, a degradation product of a natural material, a degradation product of a synthetic material, ash, inorganic material, and any combination thereof.

Clause 11: The method of one of clauses 1-10, wherein the third pressure is different from the second pressure by at least about 20% of the second pressure; and wherein the method further comprises: adjusting the third pressure to a fourth pressure, wherein the fourth pressure is within about 20% of the second pressure.

Clause 12: The method of clause 11, wherein the contacting, depositing, optional displacing, rapid changing, and adjusting steps are performed while maintaining a pressure of at least about 500 psia.

Clause 13: The method of clause 11 or 12, wherein the method is repeated at least once, and wherein at least about 20 seconds elapse between subsequent rapid changing steps.

Clause 14: The method of any one of clauses 11-13, wherein the method is repeated at least once, and wherein at least about 30 minutes elapse between subsequent rapid changing steps.

Clause 15: The method of any one of clauses 1-14, wherein the displacing step is performed.

Clause 16: The method of any one of clauses 1-15, wherein the first fluid comprises hot compressed water.

Clause 17: The method of any one of clauses 1-16, wherein the first fluid comprises supercritical water.

Clause 18: The method of any one of clauses 15-17, wherein: the third pressure is different from the second pressure by at least about 20% of the second pressure; and the method further comprises: adjusting the third pressure to a fourth pressure, wherein the fourth pressure is within about 20% of the second pressure; and supplanting the first fluid with a third fouling fluid that has a composition that is the same as or different from a composition of the first fouling fluid.

Clause 19: The method of clause 18, wherein the method is repeated at least once, and wherein at least about 20 seconds elapse between subsequent rapid changing steps.

Clause 20: The method of clause 18 or 19, wherein the contacting, depositing, optional displacing, rapid changing, and adjusting steps are performed, and the method is repeated at least once, while maintaining a pressure of at least about 500 psia.

Clause 21: The method of any one of clauses 1-20, wherein the method does not employ an exogenous compound in an amount effective to remove a substantial portion of the fouling substance deposited on the interior surface of the fouled first pressurized vessel, wherein the exogenous compound is selected from the group consisting of an acid, a base, an organic solvent, and any combination thereof.

Clause 22: The method of any one of clauses 1-21, wherein at least one solid is added to the first fouling fluid, the first fluid if present, or a mixture thereof prior to or during the rapid changing step, wherein the at least one solid is selected from the group consisting of a powder, metal, magnetic metal, cellulose, microcrystalline cellulose, nanocrystalline cellulose, sand, inorganic material, biomass, insoluble C5 saccharides, insoluble C6 saccharides, lignin, and combinations thereof.

Clause 23: The method of any one of clauses 1-22, wherein the first fouling fluid, the first fluid if present, or a mixture thereof is transported continuously through the vessel.

Clause 24: The method of any one of clauses 1-23, wherein the third velocity is different from the second velocity by a factor of at least 2.

Clause 25: The method of any one of clauses 1-24, wherein the second velocity changes to the third velocity at an acceleration of at least about 0.3 m/s2.

Clause 26: The method of any one of clauses 1-25, wherein the second pressure is rapidly changed to the third pressure at a rate of at least about 100 psi/sec.

Clause 27: The method of clauses 1-26, wherein rapidly changing the second pressure to the third pressure comprises a decrease in pressure.

Clause 28: The method of clause 27, wherein at least a portion of the first fouling fluid, the first fluid if present, or a mixture thereof is vaporized inside the fouled first pressurized vessel when rapidly decreasing the second pressure to the third pressure.

Clause 29: The method of any one of clauses 1-28, wherein: the first pressure and the second pressure are maintained using a first valve; and rapidly changing the second pressure to the third pressure occurs by opening a second valve.

Clause 30: The method of clause 29, wherein the first valve is closed substantially simultaneously with the opening of the second valve, thereby achieving the rapid change from the second pressure to the third pressure.

Clause 31: The method of any one of clauses 1-28, wherein: the first pressure and the second pressure are maintained using a first valve; and rapidly changing the second pressure to the third pressure occurs by further opening the first valve.

Clause 32: The method of any one of clauses 1-31, further comprising: providing a second pressurized vessel having an interior surface; contacting the interior surface of the second pressurized vessel with a second fouling fluid; wherein: the second fouling fluid has a composition that is the same as or different from a composition of the first fouling fluid; the second pressurized vessel has a fifth pressure at a second position inside the second pressurized vessel; and the second fouling fluid has a fourth velocity at the second position; depositing a second fouling substance originating from the second fouling fluid on at least a portion of the interior surface of the second pressurized vessel, thereby forming a fouled second pressurized vessel having a sixth pressure at the second position and a fifth velocity at the second position; wherein the second fouling substance is the same as or different from the first fouling substance; optionally, displacing at least a portion of the second fouling fluid contained in the fouled second pressurized vessel with a second fluid that is different from the second fouling fluid; and rapidly changing the sixth pressure of the second fouled pressurized vessel to a seventh pressure, thereby causing the second fouling fluid, the second fluid if present, or a mixture thereof within the fouled second pressurized vessel to achieve a sixth velocity at the second position, wherein the sixth velocity is greater than the fifth velocity; wherein the process removes a portion of the second fouling substance deposited on the interior surface of the fouled second pressurized vessel.

Clause 33: The method of clause 32, wherein displacing at least a portion of the second fouling fluid with a second fluid is performed; and wherein the second fluid comprises hot compressed water.

Clause 34: The method of clause 32 or 33, wherein depositing the second fouling substance on at least a portion of the interior surface of the second pressurized vessel is performed at substantially the same time as rapidly changing the second pressure to a third pressure within the fouled first pressurized vessel.

Clause 35: The method of any one of clauses 32-34, wherein the second fouling fluid has a temperature of at least about 340° C. upon commencing the rapid change from the second pressure to the third pressure.

The present invention is further defined in the following Examples. It should be understood that these examples, while in some cases indicating preferred embodiments of the invention, are given by way of illustration only and are not to be construed as limiting in any manner. From the above discussion and these examples, one skilled in the art can ascertain the essential characteristics of this invention, and without departing from the spirit and scope thereof, can make various changes and modifications of the invention to adapt it to various usages and conditions.

EXAMPLES

The methods disclosed herein generally take advantage of the high pressures already present in a pressurized vessel system to remove fouling material that has accumulated on the interior surface of the pressurized vessel (such as a reactor or pipe) without substantially interrupting normal operations of the pressurized vessel (such as hydrolysis of lignocellulosic biomass in a pressurized vessel). As shown with reference to system 1 in FIG. 1, under normal operating conditions (e.g., during hydrolysis of biomass), a slurry of biomass from tank 3 is pumped to high pressure (not shown) and contacted with hot compressed water (e.g., supercritical water) from hot compressed water heater/tank 4 just prior to or upon entering reactor 2, where the slurry is maintained at elevated temperature and pressure for a given residence time (typically about 1.5 seconds or less). The biomass of the slurry can be lignocellulosic biomass (e.g., size reduced raw biomass), a slurry of the solids remaining after fractionation (e.g., hydrolysis of lignocellulosic biomass to remove at least a portion of hemicellulose), pretreated biomass (e.g., with acid, base, sulfur dioxide, etc.), or any biomass as defined elsewhere herein, or any combination thereof. The reactor can be any suitable reactor, including a tube or pipe. The reacted biomass slurry flows through letdown valve 5 that maintains the pressure of the system, and then through piping 7 before being collected in product tank 6. The reactor and surrounding pipes (both upstream and downstream) typically become fouled over time with a fouling substance (such as lignin, polyfurans, breakdown products of sugars and/or lignin, and other organics, or any combination thereof).

The fouling substance is removed according to the methods disclosed herein, which involve, e.g., a rapid pressure change (increase or decrease) step that "blows out" the fouling material, achieving an increased velocity of the fluid flowing therein and, in some embodiments, vaporization of at least a portion of the fluid flowing therein. In some embodiments, the slurry flow is optionally switched over to pure water or substantially pure water (e.g., at substantially the same pressure as the system) prior to or during the rapid pressure changing step. Switching to pure or substantially pure water can be achieved by stopping the flow of biomass slurry from tank 3 and maintaining or increasing flow (or even perhaps using a decreased flow) of hot compressed water from tank 4. Alternatively, a different water (e.g., hot compressed or ambient water) tank (not shown) can be employed instead of, or in conjunction with, hot compressed water tank/heater 4. For example, slurry flow from tank 3 can be switched to pure water at ambient temperature (i.e., slurry flow is stopped), and the ambient temperature water is contacted with hot compressed water from tank 4. The rapid pressure change is then performed while the mixture of ambient water and hot compressed water is flowing through the reactor 2. Performing the method in this manner allows the temperature and pressure within the reactor to be substantially the same as when slurry and hot compressed water is flowing through the reactor (i.e., when normal processing is occurring), reducing the shock experienced by the reactor/system. In some embodiments, the rapid pressure change is performed by opening "blow out" valve 8, with or without closing letdown valve 5, thereby rapidly changing (e.g., increasing, decreasing, or both) the pressure in the system, and achieving an increased velocity of the fluid flowing within the vessel (typically both upstream and downstream of the blow out and/or letdown valve). Typically, the pressure is measured at a position in the system upstream of the valve(s), and, when the valves are opened, the pressure of the system upstream of the valves rapidly changes as described herein. In some embodiments, the rapid pressure change is performed by opening letdown valve 5 to achieve the same effects. When opening valve 8, valve 5, or both, the system upstream of the valves experiences a rapid decrease in pressure, wherein the system downstream of the valve typically experiences a rapid increase in pressure. In both upstream and downstream portions of the system, the deposited fouling substance is removed. In some embodiments, the blowout valve 8 can be omitted, and the method simply performed with the letdown valve 5 (which can perform as a blowout valve when it is changed to a more open position, relative to its position when in normal backpressure operation, to achieve the rapid pressure change).

During normal operation, fouling may occur in the downstream piping 7. When the blow out (i.e., rapid pressure change) occurs, a significant quantity of material is rapidly ejected from the reactor 2 and upstream volumes 3, 4, or both. This causes a rapid increase in velocity of the material in the downstream piping. In addition to this, the blow out removes a significant amount of solid or semi-solid material from the interior walls of the vessel/reactor. Rapid acceleration of the fluid in the piping, the increased concentration of solids, possible vaporization of the liquid therein, and the temporary increase in fluid velocity combine to scour the vessel walls and effect an efficient cleaning of both the downstream and upstream (relative to the blow out valve) portions of the system.

The material (fluid and solid) may be vented via line 9 and/or collected via line 10 in tank 6. Switching to pure water prior to blow out is optional and is not necessary, as the blow out method can be performed equally well with the biomass slurry (switching to pure water, however, conserves slurry).

The blowout method is performed periodically (i.e., repeated), for example, at least every 20 sec. However, the longer the period between "blow outs," the more uptime of the system, and the less collective stress the equipment experiences. Typically, the blowout is performed before the fouling can deleteriously affect the system, for example, every 30 to 90 minutes. Guidelines for determining when a blow out may ideally be performed is described elsewhere herein. Thus, the adhered fouling substance is removed periodically with the methods disclosed herein, before substantially negative consequences are detected. The blow out is typically performed by rapidly decreasing the pressure of the reactor. However, in different sections of the system, a rapid increase in pressure is experienced, which also removes any fouling substance from that section of the system. The rapid pressure change (usually a decrease but can be an increase) is typically accomplished by opening blowout valve 8 and/or letdown valve 5 for a short period of time (on the order of seconds, such as 3 seconds to 30 seconds for example), then the blowout valve 8 and/or letdown valve 5 is closed, returning the system to within range of the pre-blow out pressure after a time period (on the order seconds to single digit minutes, for example).

Figure 4:
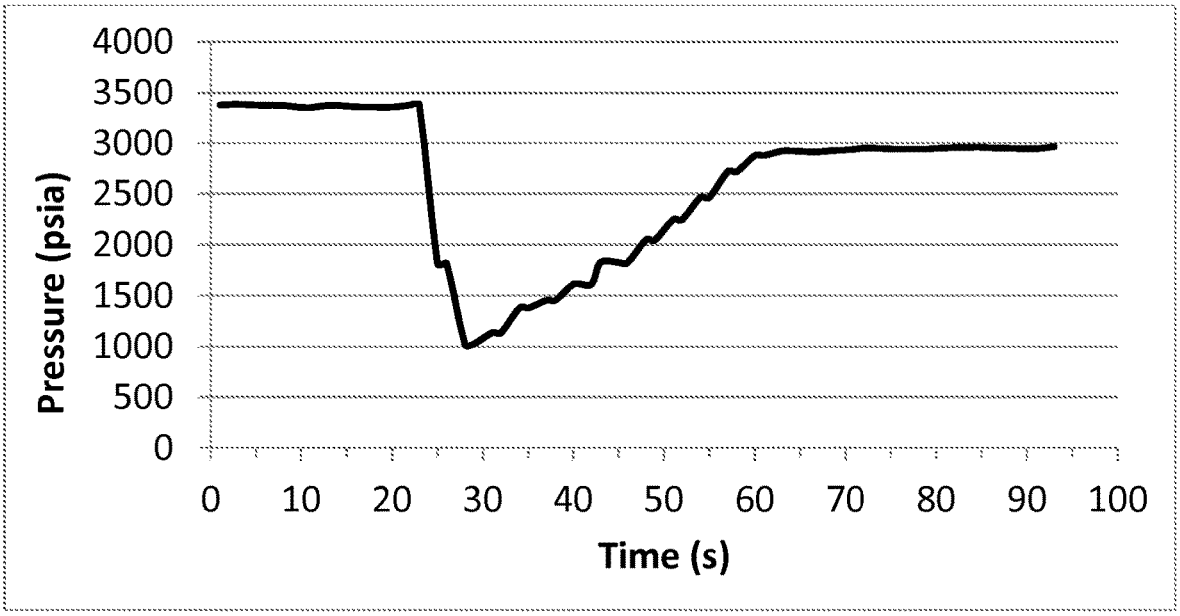
FIG. 4 is a plot depicting the pressure vs. time for a pressurized vessel operated in accordance with some embodiments of the methods disclosed herein.

A typical pressure vs. time profile in accordance with some embodiments of the methods described herein is shown in FIG. 4. The pressure is measured within the pressurized vessel at a point upstream of both the letdown valve and blow out valve. The rapid pressure change is commenced at about 23 sec and is completed at about 28 sec (about 5 sec duration) by opening a blow out valve. The pressure drops from about 3370 psia to about 1000 psia in this time period. The blow out valve is closed at the 28 sec mark, and the pressure is then adjusted to within about 20% of the initial pressure within a time period of about 30-35 sec. Given enough time, on the order of 30 seconds to a few minutes, the pressure will continue to increase and eventually be substantially the same as the initial pressure prior to the blow out. However, this return to initial pressure prior to blow out can be effected more quickly (or more slowly) if desired. It should be noted that the data for FIG. 4 was collected about every 2 seconds, which provides a suitable qualitative plot, but typically is not frequent enough to quantitatively determine a peak rate of pressure change. To determine peak rate of pressure change, pressure data should be collected at least every 0.5 sec, as described elsewhere herein, though more frequent sampling is more desirable.

Figure 2:
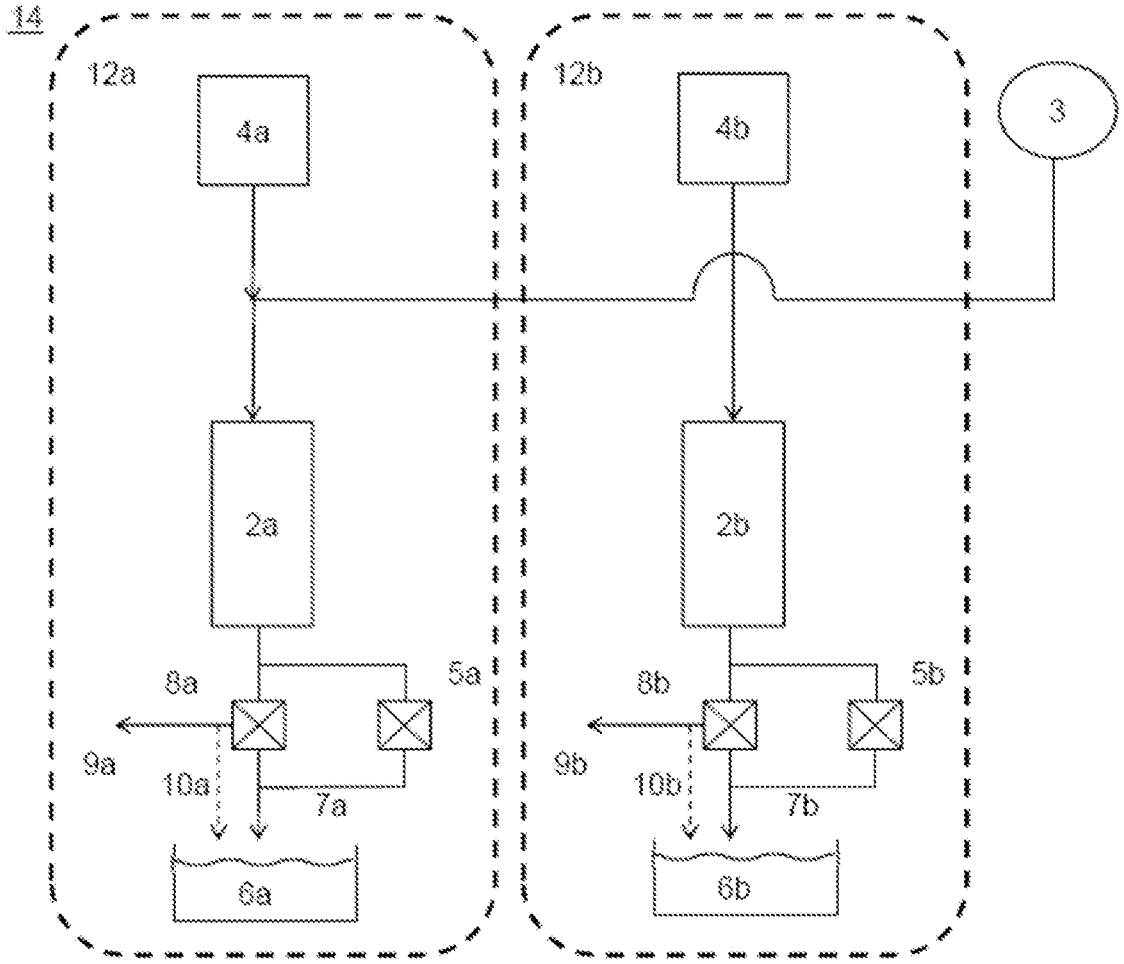
FIG. 2 is a schematic diagram of the method in some embodiments where multiple vessels and multiple fluid heaters or tanks are used in a substantially simultaneous mode.
Figure 3:
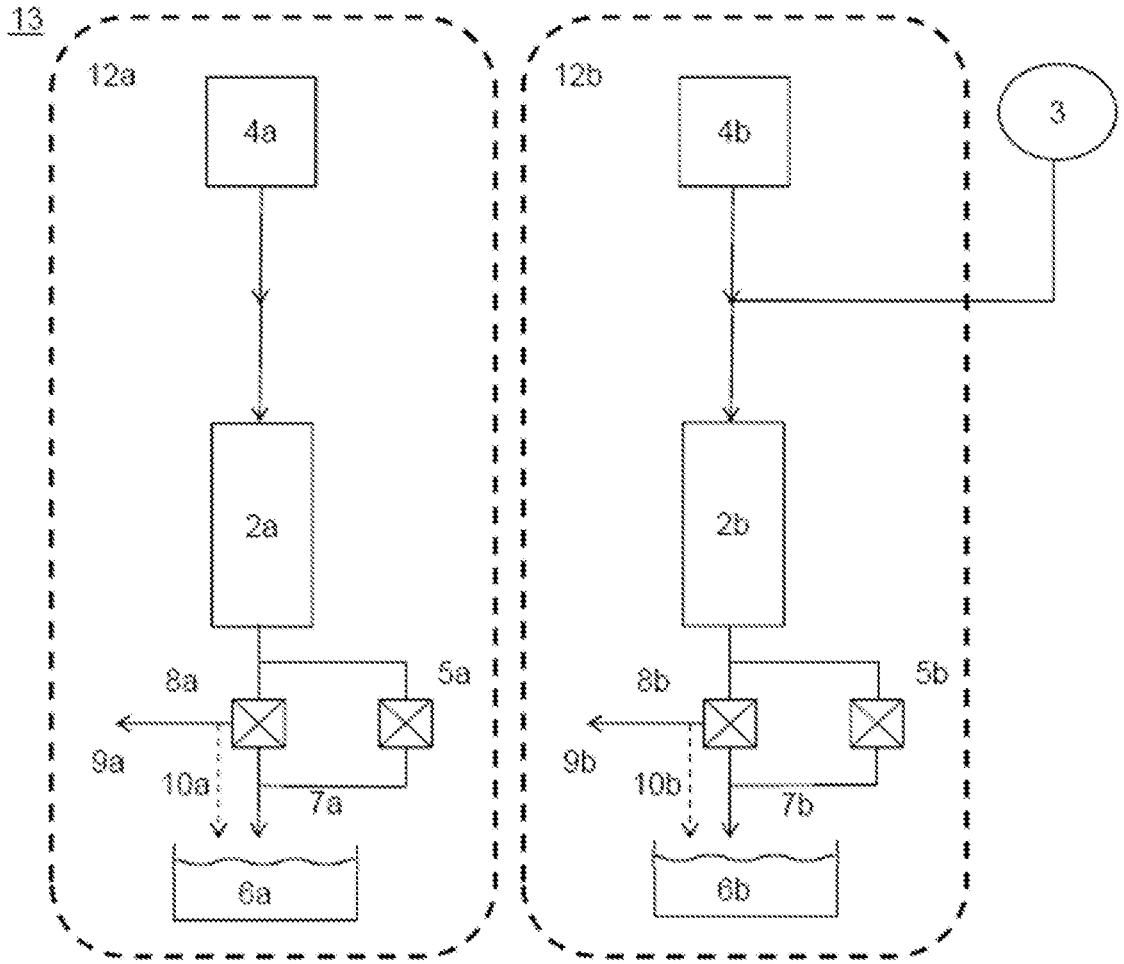
FIG. 3 is a schematic diagram of the method in some embodiments where multiple reactors and multiple supercritical water heaters or tanks are used in an alternative mode.

The system and method described above with reference to FIG. 1 employ a single supercritical water heater or tank and a single reactor, which is preferred in some embodiments, because it avoids the need to employ multiple reactors and/or multiple supercritical water heater/tanks. However, as shown in FIGS. 2 and 3, in some embodiments, the system and method may employ multiple reactors (2*a*, 2*b*), multiple hot compressed water heaters or tanks (4*a*, 4*b*), or multiple reactors (2*a*, 2*b*) and multiple hot compressed water heaters or tanks (4*a*, 4*b*), where subsystems 12*a*, 12*b* are employed. The features of FIGS. 2 and 3 are the same as those in FIG. 1, except the feature numbers are followed by letters in some cases simply for distinguishing purposes. The two subsystems (12*a*, 12*b*) are essentially two of the apparatuses shown in FIG. 1 operating side by side. These two subsystems (12*a*, 12*b*) can be simultaneously run in parallel, but may be independently "blown out," as needed.

In FIG. 2, although not depicted, subsystem 12*b* was just being employed to process biomass slurry from slurry tank 3 using hot compressed water from tank 4*b* and is therefore a fouled pressurized vessel. To remove the fouling from reactor 2*b*, the biomass slurry first is switched to being fed to subsystem 12*a*, so as to come into contact with hot compressed water from tank 4*a* in reactor 2*a*. At the same time, hot compressed water from tank 4*b* in subsystem 12*b* is fed through reactor 2*b* during a rapid pressure changing step of subsystem 12*b* in order to remove fouling that had been deposited therein. See FIG. 2. The operation of subsystem 12*a* is the same as the operation of system 1 in FIG. 1 described hereinabove. Once reactor 2*a* of subsystem 12*a* is fouled, the biomass slurry is switched to being fed to reactor 2*b* of subsystem 12*b*, and subsystem 12*b* is operated the same as system 1 of FIG. 1. At the same time hot compressed water from tank 4*a* in subsystem 12*a* is fed through reactor 2*a* during a rapid pressure changing step of subsystem 12*a* in order to remove fouling that had been deposited therein. See FIG. 3. The operation of subsystem 12*b* is the same as the operation of system 1 in FIG. 1 described hereinabove. Once reactor 2*b* of subsystem 12*b* is fouled, the process can be repeated.

When ranges are used herein for physical properties, such as molecular weight, or chemical properties, such as chemical formulae, all combinations, and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means plus function treatment for any limitations of any of the claims herein, except for those in which the claim expressly uses the words "means for" together with an associated function.

What is claimed is:

1. A method comprising:

providing a fouled first pressurized vessel having:

a first fouling substance deposited on at least a portion of an interior surface of the fouled first pressurized vessel; wherein the first fouling substance is derived from processed biomass;

a first pressure at a first position inside the fouled first pressurized vessel; and a first fouling fluid having a first velocity at the first position, wherein the first fouling fluid comprises lignin and cellulose;

displacing at least a portion of the first fouling fluid contained in the fouled first pressurized vessel with a first fluid that is different from the first fouling fluid; and rapidly changing the first pressure to a second pressure, thereby causing the first fouling fluid, the first fluid if present, or a mixture thereof within the fouled first pressurized vessel to achieve a second velocity at the first position, wherein the second velocity is greater than the first velocity;

wherein the method removes a portion of the first fouling substance deposited on the interior surface of the fouled first pressurized vessel.

2. The method of claim 1, wherein the method removes at least 30 wt. % of the first fouling substance deposited on the interior surface of the fouled first pressurized vessel.

3. The method of claim 1, wherein the second pressure is different from the first pressure by at least about 20% of the first pressure.

4. The method of claim 1, wherein changing the first pressure to the second pressure occurs in a first time period of less than about 10 sec.

5. The method of claim 1, wherein the first pressure is at least about 1000 psia.

6. The method of claim 1, wherein the first fouling fluid, the first fluid if present, or a mixture thereof has a temperature of at least about 300° C. upon commencing the rapid change from the first pressure to the second pressure.

7. The method of claim 1, wherein the first fouling fluid is at least partially removed from the fouled first pressurized vessel prior to feeding the first fluid into the fouled first pressurized vessel.

8. The method of claim 1, wherein the first fluid, or a mixture of the first fluid and the first fouling fluid, has a temperature of at least about 370° C. upon commencing the rapid change from the first pressure to the second pressure.

9. The method of claim 1, wherein:

the second pressure is different from the first pressure by at least about 20% of the first pressure; and the method further comprises:

adjusting the second pressure to a third pressure, wherein the third pressure is within about 20% of the first pressure.

10. The method of claim 9, wherein at least about 60 seconds elapse between the rapid changing step and the adjusting step, and wherein the method is repeated at least once.

11. The method of claim 9, wherein at least about 15 minutes elapse between the rapid changing step and the adjusting step, and wherein the method is repeated at least once.

12. The method of claim 9, wherein the displacing, rapid changing, and adjusting steps are performed, and the method is repeated at least once, while maintaining a pressure of at least about 500 psia.

13. The method of claim 9, wherein the method is performed on a system having an uptime of at least about 90%.

14. The method of claim 1, wherein the method does not employ an exogenous compound in an amount effective to remove a substantial portion of the fouling substance deposited on the interior surface of the fouled first pressurized vessel, wherein the exogenous compound is selected from the group consisting of an acid, a base, an organic solvent, and any combination thereof.

15. The method of claim 1, wherein the first fouling fluid, the first fluid if present, or a mixture thereof is transported continuously through the vessel.

16. The method of claim 1, wherein the first velocity changes to the second velocity at an acceleration of at least about 0.3 $m/s^2$.

17. The method of claim 1, wherein the first pressure is rapidly changed to the second pressure at a rate of at least about 100 psi/sec.

18. The method of claim 1, wherein rapidly changing the first pressure to the second pressure comprises a decrease in pressure.

19. The method of claim 18, wherein at least a portion of the first fouling fluid, the first fluid if present, or a mixture thereof is vaporized inside the fouled first pressurized vessel when rapidly changing the first pressure to the second pressure.

* * * * *